United States Patent [19]

Ohno et al.

[11] Patent Number: 4,933,268

[45] Date of Patent: Jun. 12, 1990

[54] SILVER HALIDE PHOTOGRAPHIC MATERIAL HAVING AT LEAST ONE DYED HYDROPHILIC COLLOID LAYER

[75] Inventors: Shigeru Ohno; Tadashi Ito; Sumito Yamada; Tomokazu Yasuda; Keiichi Adachi, all of Kanagawa, Japan

[73] Assignee: Fuji Photo Film Co., Ltd., Kanagawa, Japan

[21] Appl. No.: 270,585

[22] Filed: Nov. 14, 1988

[30] Foreign Application Priority Data

| | | | |
|---|---|---|---|
| Nov. 11, 1987 | [JP] | Japan | 62-284447 |
| Nov. 11, 1987 | [JP] | Japan | 62-284448 |
| Dec. 18, 1987 | [JP] | Japan | 62-320703 |

[51] Int. Cl.[5] ..... G03C 1/84

[52] U.S. Cl. ..... 430/518; 430/522; 430/941

[58] Field of Search ..... 430/522, 518

[56] References Cited

U.S. PATENT DOCUMENTS

| | | | |
|---|---|---|---|
| 3,984,246 | 10/1976 | Ohlschlager et al. | 430/522 |
| 4,179,294 | 12/1979 | Sagiyama et al. | 430/522 |
| 4,266,014 | 5/1981 | Moelants et al. | 430/522 |
| 4,833,246 | 5/1989 | Adachi et al. | 430/522 |

FOREIGN PATENT DOCUMENTS

| | | | |
|---|---|---|---|
| 0286331 | 10/1988 | European Pat. Off. | 430/522 |

*Primary Examiner*—Richard L. Schilling
*Attorney, Agent, or Firm*—Sughrue, Mion, Zinn, Macpeak & Seas

[57] ABSTRACT

A silver halide photographic material comprising a support having thereon at least one hydrophilic colloid layer containing at least one dye represented by formula (I), (I)

wherein $R_1$ represents a substituted aryl group, a substituted or unsubstituted alkyl group, a substituted or unsubstituted aralkyl group, or a substituted or unsubstituted heterocyclic group, each group being substituted by at least one carboxylic acid group or sulfonic acid group; $R_2$ represents —$CONR_3R_4$ or —$NR_3COR_4$, wherein $R_3$ represents a hydrogen atom or an alkyl group and $R_4$ represents a substituted or unsubstituted alkyl group or a substituted or unsubstituted aralkyl group having a hydrophobic substituent constant $\pi$ in the range of about $1.60 \leqq \pi \leqq$ about 3.90; $L_1$, $L_2$, and $L_3$ each represents a substituted or unsubstituted methine group; and n represents 0, 1, or 2.

26 Claims, No Drawings

SILVER HALIDE PHOTOGRAPHIC MATERIAL HAVING AT LEAST ONE DYED HYDROPHILIC COLLOID LAYER

FIELD OF THE INVENTION

This invention relates to a silver halide photographic material having at least one dyed hydrophilic colloid layer, and more particularly to a silver halide photographic material having at least one hydrophilic colloid layer containing a dye which is photochemically inactive and easily discolored and/or dissolved off during photographic processing.

BACKGROUND OF THE INVENTION

In silver halide photographic materials, it has been frequent practice to color a photographic emulsion layer or other layer in order to absorb light of a specific wavelength region.

For example, when it is necessary to control the spectral composition of light entering a photographic emulsion layer, a colored layer is formed in the photographic light-sensitive material at the side of the photographic emulsion layer farther from the support (i.e., the light entering side of the emulsion layer). Such a colored layer is called a filter layer. When plural photographic emulsion layers exist as a multilayer color photographic material, the filter layer sometimes is disposed between the emulsion layers.

Also, it has been known to form a colored layer between a photographic emulsion layer and a support of a silver halide photographic material or on the support at the opposite side to the emulsion layer-carrying side thereof for preventing the occurrence of halation, that is, the occurrence of fading of images based on the reincidence of light, which was scattered during or after passing through the photographic emulsion layer, reflected at the interface between the emulsion layer and the support or at the surface of the photographic material opposite to the emulsion layer side. Such a colored layer is called an "antihalation layer". In the case of a multilayer color photographic material, the antihalation layer is, sometimes, disposed between the photographic emulsion layers.

Furthermore, in a radiographic light-sensitive material, a colored layer for improving the sharpness is, sometimes, formed as a crossover cut filter for reducing crossover light.

Also, for preventing the reduction of the image sharpness based on the scattering of light in the photographic emulsion layer (this phenomenon is generally called "irradiation"), sometimes the photographic emulsion layer is colored.

These various layers which are colored are usually composed of a hydrophilic colloid and hence for coloring them, a water-soluble dye is usually incorporated in the colored layer. The dye is required to meet the following conditions:

(1) The dye should have an appropriate spectral absorption according to the practical purpose of the material.

(2) The dye should be photochemically inactive. That is, the dye should not give harmful influences, chemically to the performance of silver halide photographic emulsion layers, such as the reduction of sensitivity, fading of latent images formed, and the formation of fog.

(3) The dye should be discolored or dissolved off during photographic processing, so that a harmful color is not left on the photographic light-sensitive material after processing.

Also, when the colored layer is a filter layer or an antihalation layer which is disposed at the photographic emulsion side of a photographic light-sensitive material, it is further required that the dye does not substantially diffuse into other layer(s). This is because if the dye diffuses into other layer(s), not only will the effect of the dye-containing layer as a filter layer or an antihalation layer be reduced but also the dye gives a harmful spectral action to other layer(s).

Various efforts have been made forwards discovering dyes meeting the aforesaid conditions and, in particular, oxonol dyes having two pyrazolone nuclei have a property of being discolored in a developer containing a sulfite and have been used for photographic light-sensitive materials as useful dyes giving less harmful influence on photographic emulsions. For example, there are oxonol dyes having a specific substituent at the 3-position of the pyrazolone nucleus as described in JP-A-50-91627, 50-147712 (corresponding to U.S. Pat. No. 3,989,528), 51-32325 (corresponding to U.S. Pat. No. 4,059,448), 52-34716, 58-143342, and 59-111641. The term "JP-A" as used herein means an "unexamined published Japanese patent application".

Also, there are methods of combining a basic polymer and a dye as described in JP-A-51-32325 and 52-34716.

However, the kinds of dyes capable of selectively dyeing only a specific layer such as a filter layer or an antihalation layer by itself, without substantially the need for a mordant, etc., and which do not leave a harmful color on the photograhic light-sensitive material after photographic processing, as well as dyes which can perform both the selective dyeing and discoloring even in the case of using mordant, are quite few.

Examples of other dyes which are used for the aforesaid purposes are the oxonol dyes having a pyrazolone nucleus or a barbituric acid nucleus described in British Patent Nos. 506,385, 1,177,429, 1,311,884, 1,338,799, 1,385,371, 1,467,214, 1,433,102, and 1,533,516, JP-A-48-85130, 49-11420, 55-161233, 59-38742, and 59-111640, U.S. Pat. Nos. 3,247,127, 3,469,985, and 4,078,933, other oxonol dyes described in U.S. Pat. Nos. 2,533,472 and 3,379,533, British Patent No. 1,278,621, etc., the azo dyes described in British Patent Nos. 575,691, 680,631, 599,623, 786,907, 907,125, and 1,045,609, U.S. Pat. No. 4,255,326, JP-A-59-211043 (corresponding to U.S. Pat. No. 4,559,296), etc., the azomethine dyes described in JP-A-50-100116 and 54-118247 (corresponding to U.S. Pat. No. 4,234,677), British Patent Nos. 2,014,598 and 750,031, etc., the anthraquinone dyes described in U.S. Pat. No. 2,865,752, the arylidene dyes described in U.S. Pat. Nos. 2,538,009, 2,688,541, 2,538,008, British Patent Nos. 584,609 and 1,210,252, JP-A-50-40625, 51-3623, 51-10927, and 54-118247, JP-B-48-3286 (corresponding to U.S. Pat. No. 3,687,670) and 59-37303 (the term "JP-B" as used herein means an "examined published Japanese patent application"), the styryl dyes described in JP-B-28-3082, 44-16594 and 59-28898, the triarylmethane dyes described in British Patent Nos. 446,583 and 1,335,422, JP-A-59-228250, the merocyanine dyes described in British Patent Nos. 1,075,653, 1,153,341, 1,284,730, 1,475,228, 1,542,807, etc., and the cyanine dyes described in U.S. Pat. Nos. 2,843,486, 3,294,539, etc.

In these dyes, the oxonol dyes having two pyrazolone nuclei have a property of being discolored in a developer containing a sulfite, and have been used for photographic light-sensitive materials as useful dyes giving less harmful influences on the photographic emulsions.

However, some of this series of dyes have a fault of spectrally sensitizing the photographic emulsion containing the dye to an unnecessary zone or of reducing the sensitivity thereof. This is considered to be caused by desorbing sensitizing dye(s) although these dyes give less harmful influences on the photographic emulsion itself.

Also, according to quickened or rapid photographic processing which has been practiced recently, some of the aforesaid dyes remain after processing. For solving this problem, it has been proposed to use dyes having a high reactivity with a sulfite ion but in this case, there is a fault that the dyes are insufficient in stability in the photographic emulsion layer, cause a reduction in density with the passage of time, and desired photographic effects cannot be obtained.

On the other hand, when the colored layer is a filter layer or an antihalation layer disposed at the photographic emulsion side of a photographic light-sensitive material, it is usually required that the layer only be selectively colored and other layers are not substantially colored.

For selectively dyeing a specific hydrophilic colloid layer, there are various known methods, but a method of using a hydrophilic polymer including a moiety having static charges opposite to those of a dye ion as a mordant in the hydrophilic colloid layer together with the dye and localizing the dye in the specific layer by the coaction of the polymer and the dye molecule (the coaction is considered to be the attraction by the static charges and a hydrophobic bonding) is most frequently used.

Examples of mordants which are used for this purpose are vinylpyridine polymers and vinylpyridinium cation polymers described in U.S. Pat. Nos. 2,548,664 and 3,148,061 and JP-B-59-31696, vinylimidazolium cation polymers described in U.S. Pat. No. 4,124,386, JP-B-55-29418 (corresponding to U.S. Pat. No. 4,124,386) and JP-A-59-55436, polymer mordants crosslinkable with gelatin, etc., described in U.S. Pat. No. 3,625,694, aqueous sol type mordants described in U.S. Pat. No. 3,958,995 and JP-A-54-115228, mordants having an ammonium structure described in U.S. Pat. Nos. 3,898,088 and 3,958,995, JP-A-49-121523 and 55-33172, reactive mordants capable of forming a covalent bond with a dye described in U.S. Pat. No. 4,168,976, polymers induced from ethylenically unsaturated compounds having a dialkylaminoalkyl ester residue as described in British Patent No. 685,475, the products obtained by the reaction of polyvinyl alkyl ketone and aminoguanidine as described in British Patent No. 850,281, U.S. Pat. No. 2,822,156 and JP-B-49-15820 (corresponding to U.S. Pat. No. 3,706,563), and the polymers induced from 2-methyl-1-vinylimidazole as described in U.S. Pat. No. 3,445,231.

In the case of using the aforesaid method with a polymer mordant, when the layer containing a dye is brought into contact with other hydrophilic colloid layer in wet states, a part of the dye often diffuses from the former layer into the latter layer. The diffusion of the dye not only depends on the chemical structure of the mordant but also depends on the chemical structure of the dye used.

Also, when the aforesaid polymer mordant is used, residual color is liable to remain on the photographic light-sensitive material after photographic processing, in particular, photographic processing with shortened processing time. This is considered to be due to the theory that since the bonding power of the mordant to dye remains to some extent after processing, although the bonding power is considerably weakened in an alkaline solution such as a developer, the dye or a reversible discolored product thereof remain in the layer containing the mordant. Such a difficulty largely depends on the chemical structures of the mordant and the dye.

For overcoming these difficulties, a method of combining a basic polymer and a specific dye is known as described in JP-A-51-32325 and 52-34716. However, it is difficult by such a method to selectively dye only a specific layer without leaving color in the photographic light-sensitive material after photographic processing in a quickened photographic process, which is often employed in practice recently.

SUMMARY OF THE INVENTION

A first object of this invention is, therefore, to provide a silver halide photographic material having a hydrophilic colloid layer dyed by a novel water-soluble dye which does not give harmful influences on the photographic characteristics of the silver halide emulsion layer(s).

A second object of this invention is to provide a silver halide photographic material, in which only a specific hydrophilic colloid layer is dyed by a novel water-soluble dye excellent in discoloring property upon photographic processing.

A third object of this invention is to provide a silver halide photographic material having a hydrophilic colloid layer dyed by a novel water-soluble dye which is stable in the layer with the passage of time.

A fourth object of this invention is to provide a silver halide photographic material having a mordant-containing hydrophilic colloid layer selectively and sufficiently dyed by a dye excellent in discoloring upon photographic processing.

A fifth object of this invention is to provide a silver halide photographic material having a dyed hydrophilic colloid layer, which layer gives no harmful influences on the photographic characteristics of the photographic emulsion layer(s) even when the photographic light-sensitive material is stored for a long time.

It has now been discovered that the aforesaid and other objects and advantages can be attained by the present invention described below.

That is, according to this invention, there is provided a silver halide photographic material composing a support having thereon at least one hydrophilic colloid layer containing at least one dye represented by formula (I),

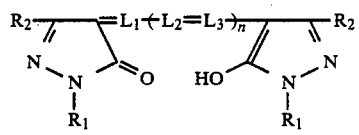

(I)

wherein $R_1$ represents a substituted aryl group, a substituted alkyl group, a substituted aralkyl group, or a substituted heterocyclic group, each group being substituted by at least one carboxylic acid group or sulfonic acid group; $R_2$ represents —$CONR_3R_4$ or —$NR_3COR_4$, wherein $R_3$ represents a hydrogen atom or an alkyl group and $R_4$ represents a substituted or unsubstituted alkyl group or a substituted or unsubstituted aralkyl group having a hydrophobic substituent constant $\pi$ in the range of about $1.60 \leqq \pi \leqq$ about 3.90; $L_1$, $L_2$, and $L_3$ each represents a substituted or unsubstituted methine group; and n represents 0, 1, or 2.

DETAILED DESCRIPTION OF THE INVENTION

The dyes of formula (I) for use in this invention are described in detail below.

The carboxylic acid group or the sulfonic acid group substituted on each of the aryl group, alkyl group, aralkyl group, and heterocyclic group shown by $R_1$ may be bonded to the aryl group, alkyl group, aralkyl group, or heterocyclic group directly or through a divalent linkage group such as an alkyleneoxy group preferably having from 1 to 6 carbon atoms (e.g., 2-carboxyethoxy, 3-sulfopropoxy, and 4-sulfobutoxy), an alkyleneacylamino group preferably having from 2 to 7 carbon atoms (e.g., $\beta$-carboxypropionylamino), a phenylene group (e.g., o-sulfophenyl and p-carboxyphenyl), and alkyleneaminocarbonyl group preferably having from 2 to 6 carbon atoms (e.g., 2-sulfoethylaminocarbonyl), alkylenesulfonyl group preferably having from 2 to 6 carbon atoms (e.g., 3-sulfopropylsulfonyl), an alkyleneamino group preferably having from 2 to 6 carbon atoms (e.g., 2-sulfoethylamino, 3-sulfopropylamino, and 2-carboxyethylamino), etc.

Each of the aryl group, alkyl group, aralkyl group and heterocyclic group shown by $R_1$ may have, in addition to the carboxylic acid group or the sulfonic acid group, a substituent such as a halogen atom (e.g., chlorine, bromine, and iodine), an aryl group preferably having from 6 to 12 carbon atoms (e.g., phenyl and naphthyl), a hydroxy group, an alkyl group having from 1 to 4 carbon atoms (e.g., methyl, ethyl, propyl, butyl, and isopropyl), an alkoxy group having from 1 to 6 carbon atoms (e.g., methoxy, ethoxy, 2-hydroxyethoxy, and 2-methoxyehtoxy), an aryloxy group preferably having from 6 to 12 carbon atoms (e.g., phenoxy), an amino group preferably having from 2 to 10 carbon atoms (e.g., dimethylamino and diethylamino), an acylamino group preferably having from 2 to 10 carbon atoms (e.g., acetylamino), a cyano group, a nitro group, etc.

The alkyl group shown by $R_1$ is preferably an alkyl group of from 1 to 6 carbon atoms having at least one carboxylic acid group or sulfonic acid group (e.g., sulfomethyl, carboxymethyl, 2-sulfoethyl, 2-carboxyethyl, 3-sulfopropyl, 3-sulfo-2-methylpropyl, 3-sulfo-2,2-dimethylpropyl, 4-sulfobutyl, 4-carboxybutyl, 5-sulfopentyl, 6-sulfohexyl, 5-carboxypentyl, and 6-carboxyhexyl).

The aralkyl group shown by $R_1$ is preferably an aralkyl group of from 7 to 15 carbon atoms having at least one carboxylic acid group or sulfonic acid group (e.g., 4-sulfobenzyl, 2-sulfobenzyl, 2,4-disulfobenzyl, 2-(4-sulfobutyloxy)benzyl, 4-methyl-2-sulfobenzyl, 4-sulfophenetyl, 4-carboxybenzyl, 2,4-di(3-sulfopropyloxy)benzyl, and 2-hydroxy-4-(2-sulfoethoxy)benzyl)).

The aryl group shown by $R_1$ is preferably a phenyl group having at least one carboxylic acid group or sulfonic acid group (e.g., 4-sulfophenyl, 4-carboxyphenyl, 2-methyl-4-sulfophenyl, 3-sulfophenyl, 2,4-disulfophenyl, 3,5-disulfophenyl, 2-chloro-4-sulfophenyl, 2-methoxy-4-sulfophenyl, 4-chloro-3-sulfophenyl, 2-methoxy-5-sulfophenyl, 2-hydroxy-4-sulfophenyl, 2,5-dichloro-4-sulfophenyl, 4-phenoxy-3-sulfophenyl, 4-(3-sulfo-propyloxy)phenyl, 4-(N-methyl-N-sulfoethylamino)phenyl, 3-carboxy-2-hydroxy-5-sulfophenyl, and 2,6-diethyl-4-sulfophenyl group) or a naphthyl group having at least one carboxylic acid group or sulfonic acid group (e.g., 3,6-disulfo-$\alpha$-naphthyl, 8-hydroxy-2,6-disulfo-$\alpha$-naphthyl, 5-hydroxy-7-sulfo-$\beta$-naphthyl, and 6,8-disulfo-$\beta$-naphthyl).

The heterocyclic group shown by $R_1$ is preferably a 5- or 6-membered nitrogen-containing heterocyclic group having at least one nitrogen atom and at least one carboxylic acid group or sulfonic acid group (e.g., 5-sulfopyridin-2-yl, 5-carboxypyridin-2-yl, 6-sulfoquinolin-2-yl, 6-sulfoquinolin-4-yl, 5-sulfobenzothiazol-2-yl, 5-carboxybenzothiazol-2-yl, 6-sulfobenzoxazol-2-yl, 6-carboxybenzoxazol-2-yl, 6-sulfomethylpyridin-2-yl, and 5-sulfopyridin-2-yl).

$R_3$ represents a hydrogen atom or an alkyl group, preferably an alkyl group having from 1 to 3 carbon atoms (e.g., methyl, ethyl, n-propyl, and isopropyl) but is preferably a hydrogen atom.

$R_4$ represents an alkyl group or a substituted or unsubstituted aralkyl group having a hydrophobic substituent constant $\pi$ in the range of about $1.60 \leqq \pi \leqq$ about 3.90 and the alkyl group may have a substituent such as a hydroxy group, a carboxylic acid group, a chlorine atom, a bromine atom, a cyano group, an alkoxy group (e.g., methoxy and ethoxy), an amino group (e.g., dimethylamino and diethylamino), an amido group (e.g., acetylamino and methanesulfonamido), a carbamoyl group (e.g., methylcarbamoyl and ethylcarbamoyl), a sulfamoyl group (e.g., methylsulfamoyl and ethylsulfamoyl), etc., as long as $\pi$ is in the range of about $1.60 \leqq \pi \leqq$ about 3.90.

The value of the aforesaid hydrophobic substituent constant $\pi$ is described in C. Hansch, A. Leo, *Substituent Constants for Correlation Analysis in Chemistry and Biology*, pages 65–167, published by John Wiley & Sons, Inc., 1979. Also, the values of substituent constant $\pi$, which are not described in the aforesaid publication can be calculated by the method described in the aforesaid publication or C. Hansch et al, *Journal of Medical Chemistry*, Vol. 20, 304–306(1977). For example, the hydrophobic substituent constant $\pi_X$ of a substituent X can be obtained by subtracting the distribution coefficient $\log P_{C_6H_6}$ (wherein $\log P_{C_6H_6}=2.13$) of benzene from the distribution coefficient $\log P_{X-C_6H_5}$ of a benzene derivative ($X—C_6H_5$) having a substituent X. In addition, $\log P_{X-C_6H_5}$ can be obtained by the method described in the aforesaid publication, *Substituent Constants for Correlation Analysis in Chemistry and Biology*, pages 18–37.

In formula (I) described above, it is particularly preferred that $R_3$ represents a hydrogen atom and $R_4$ represents an unsubstituted alkyl group having from 4 to 6 carbon atoms (e.g., n-butyl, n-pentyl, n-hexyl, isobutyl, sec-butyl, tert-butyl, 1-ethylpropyl, 1-methylbutyl, 2-methylbutyl, 3-methylbutyl, 1,1-dimethylpropyl, and 2,2-dimethylpropyl), a 4-chlorobutyl group, a 7-hydroxyheptyl group, a 6-carboxyhexyl group, an 8-hydroxyoctyl group, a 2-ethylbutyl group, a 5-cyanopentyl group, a cyclopentyl group or a cyclohexyl group.

The methine group shown by $L_1$, $L_2$, or $L_3$ in formula (I) may have a substituent such as methyl, ethyl, 2-sulfoethyl, cyano, chlorine, etc.

In the aforesaid formula (I), the carboxylic acid group or the sulfonic acid group may be in the form of the free acid or a salt thereof (e.g., a sodium salt, a potassium salt, a salt of $(C_2H_5)_3NH$, a pyridinium salt, and an ammonium salt).

In a particularly preferred dye encompassed by formula (I) described above, $R_1$ is a phenyl group having at least one sulfonic acid group, an alkyl group of from 1 to 4 carbon atoms having at least one sulfonic acid group, a benzyl group having at least one sulfonic acid group, or a phenethyl group having at least one sulfonic acid group.

| Compound No. | $R_1$ | $R_2$ | $=L_1-(L_2=L_3)_n-$ |
|---|---|---|---|
| 1 | 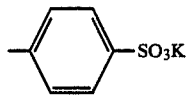 | $-NHCO^{n}C_4H_9$ | $=CH-$ |
| 2 | 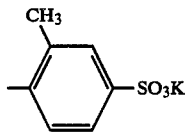 | $-NHCO^{iso}C_4H_9$ | $=CH-$ |
| 3 | 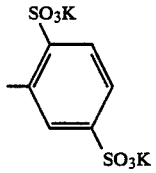 | $-NHCO^{n}C_6H_{13}$ | $=CH-$ |
| 4 | 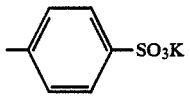 | $-NHCO^{iso}C_5H_{11}$ | $=CH-$ |
| 5 | $-(CH_2)_4SO_3K$ | $-NHCO^{n}C_4H_9$ | $=CH-$ |
| 6 | $-(CH_2)_2SO_3K$ | $-CONH^{n}C_4H_9$ | $=CH-$ |
| 7 | 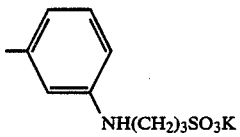 | $-CONH^{iso}C_4H_9$ | $=CH-$ |
| 8 | 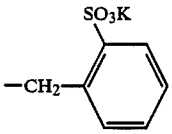 | $-CONH^{n}C_4H_9$ | $=CH-CH=CH-$ |
| 9 | $-(CH_2)_3SO_3K$ | $-CONH^{iso}C_5H_{11}$ | $=CH-CH=CH-$ |
| 10 | 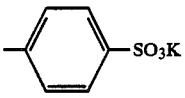 | $-CONH^{n}C_4H_9$ | $=CH-CH=CH-$ |
| 11 | 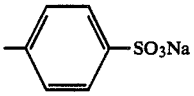 | $-CONH^{sec}C_4H_9$ | $=CH-$ |
| 12 | 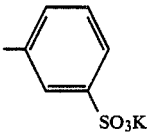 | $-NHCO(CH_2)_7OH$ | $=CH-$ |
| 13 | 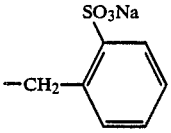 | $-NHCO^{n}C_4H_9$ | $=CH-$ |

-continued

| Compound No. | $R_1$ | $R_2$ | $=L_1-(L_2=L_3)_n-$ |
|---|---|---|---|
| 14 | $-(CH_2)_3SO_3K$ | $-NHCO^{tert}C_4H_9$ | $=CH-$ |
| 15 | 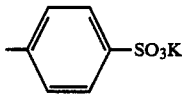 | $-NHCO^{iso}C_4H_9$ | $=CH-CH=CH-$ |
| 16 | 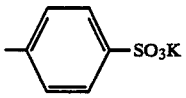 | $-NHCO^{n}C_4H_9$ | $=CH-CH=CH-$ |
| 17 | 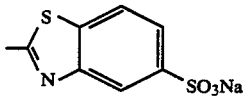 | $-CONH^{n}C_4H_9$ | $=CH-CH=CH-$ |
| 18 | 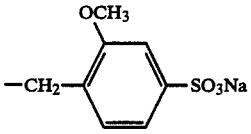 | $-CONH^{sec}C_4H_9$ | $=CH-(CH=CH)_2-$ |
| 19 | $-(CH_2)_2SO_3K$ | $-CONH^{n}C_6H_{13}$ | $=CH-CH=CH-$ |
| 20 | $-CH_2CH_2COOH$ | $-NHCO^{sec}C_4H_9$ | $=CH-(CH=CH)_2-$ |
| 21 | $-(CH_2)_2SO_3K$ | $-CON(CH_3)^{n}C_4H_9$ | $=CH-CH=CH-$ |
| 22 | 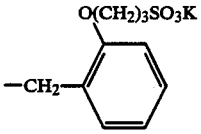 | $-CONH^{n}C_5H_{11}$ | $=CH-CH=CH-$ |
| 23 | 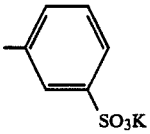 | $-CONH^{iso}C_4H_9$ | $=CH-CH=CH-$ |
| 24 | 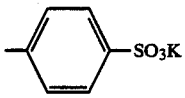 | $-CONH^{n}C_6H_{13}$ | $=CH-(CH=CH)_2-$ |
| 25 | 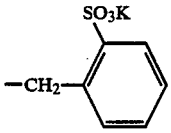 | $-CONH^{iso}C_4H_9$ | $=CH-CH=CH-$ |
| 26 | 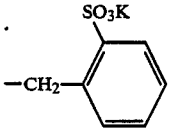 | $-CONH^{sec}C_4H_9$ | $=CH-CH=CH-$ |
| 27 | $-(CH_2)_4SO_3K$ | $-CONH(CH_2)_7OH$ | $=CH-CH=CH-$ |
| 28 | $-(CH_2)_3SO_3K$ | $CONH^{iso}C_4H_9$ | $=CH-(CH=CH)_2-$ |
| 29 | 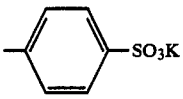 | $NHCO^{n}C_5H_{11}$ | $=CH-(CH=CH)_2-$ |

-continued

| Compound No. | $R_1$ | $R_2$ | $=L_1-(L_2=L_3)_n-$ |
|---|---|---|---|
| 30 | 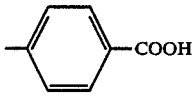 | $NHCO^{iso}C_4H_9$ | $=CH-(CH=CH)_2-$ |
| 31 | 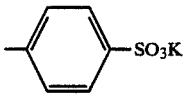 | $-CONH^nC_6H_{13}$ | $=CH-(CH=CH)_2-$ |
| 32 | 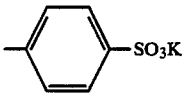 | $-NHCO^nC_4H_9$ | $=CH-$ |
| 33 | 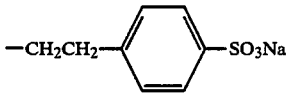 | $-CONH^nC_4H_9$ | $=CH-CH=CH-$ |
| 34 | $-(CH_2)_2SO_3K$ | $CONH^{iso}C_4H_9$ | $=CH-(CH=CH)_2-$ |
| 35 | $-(CH_2)_2SO_3K$ | $NHCO^nC_4H_9$ | $=CH-(CH=CH)_2-$ |
| 36 | $-(CH_2)_4SO_3K$ | $NCH_3CO^{iso}C_4H_9$ | $=CH-(CH=CH)_2-$ |
| 37 | 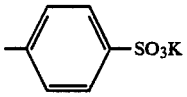 | $-NHCO^nC_4H_9$ | $=CH-\overset{CH_3}{\overset{\vert}{C}}=CH-$ |
| 38 | 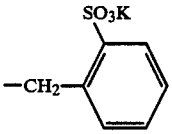 | $-CONH^nC_4H_9$ | $=\overset{CH_3}{\overset{\vert}{C}}-CH=CH-$ |
| 39 | 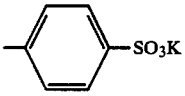 | $-CONH^nC_5H_{11}$ | $=CH-CH=\overset{CH_3}{\overset{\vert}{C}}-CH=CH-$ |
| 40 | 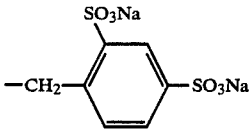 | $-CONH^nC_5H_{11}$ | $=C-CH=CH-$ |
| 41 | 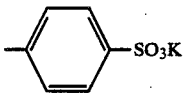 | $-CONH^nC_5H_{11}$ | $=CH-CH=CH-$ |
| 42 | 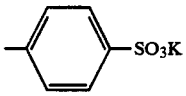 | $-CONH(CH_2)_7OH$ | $=CH-(CH=CH)_2-$ |
| 43 | 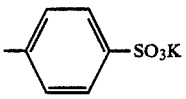 | $-CONH^nC_4H_9$ | $=CH-(CH=CH)_2-$ |
| 44 | 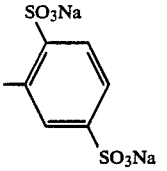 | $-CONH^nC_5H_{11}$ | $=CH-(CH=CH)_2-$ |

-continued

| Compound No. | $R_1$ | $R_2$ | $=L_1-(L_2=L_3)_n-$ |
|---|---|---|---|
| 45 | 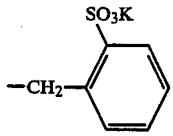 | $-NHCO^{iso}C_4H_9$ | $=CH-CH=CH-$ |

The novel dyes shown by formula (I) can be synthesized according to the methods described in JP-A-50-91627, 50-147712, and 58-143342 and also according to the typical synthesis examples shown below.

SYNTHESIS EXAMPLE 1 (SYNTHESIS OF DYE 10)

To 50 ml of methanol were added 6.8 g of 3-(n-butylcarbamoyl)-1-(p-sulfophenyl)-5-pyrazolone and 2.6 g of malonaldehydodianyl hydrochloride, and then 5.2 ml of triethylamine was added to the mixture followed by refluxing to perform the reaction for 1.5 hours. The reaction mixture obtained was cooled to room temperature and after adding thereto 3.7 g of potassium acetate dissolved in 30 ml of methanol, the resultant mixture was stirred for one hour. Crystals thus deposited were collected by filtration, washed with methanol and dried to provide 5.6 g of the desired dye. The $\lambda_{max}$ of the aqueous solution of the dye was 543 nm, m.p.; 300° C. or more.

SYNTHESIS EXAMPLE 2 (SYNTHESIS OF DYE 25)

To 70 ml of methanol were added 10.6 g of 3-(isobutyl-carbamoyl)-1-(o-sulfobenzyl)-5-pyrazolone and 3.9 g of malonaldehydodianyl hydrochloride and then 7.8 ml of triethylamine was added to the mixture followed by refluxing to perform the reaction for 1.5 hours. Then, after adding thereto 5.6 g of potassium acetate dissolved in 50 ml of methanol were added and were stirred for 30 minutes.

After cooling the reaction solution thus obtained to room temperature, 150 ml of isopropanol was added and then stirred for 2 hours. Crystals thus deposited were collected by filtration, washed with a mixture of methanol and isopropanol (1:1 by volume) and dried to provide 7.2 g of the desired dye. The λmax of the aqueous solution of the dye was 540 nm, m.p.; 283° to 286° C. (decomposition).

SYNTHESIS EXAMPLE 3 (SYNTHESIS OF DYE 31)

To 50 ml of methanol were added 7.3 g of 3-heptanoylamino-1-(p-sulfophenyl)-5-pyrazolone and 2.8 g of glutaconal-dehydrodianyl hydrochloride and then after adding thereto 5.2 ml of triethylamine, the resultant mixture was stirred for 5 hours at room temperature. Then, 3.7 g of potassium acetate dissolved in 30 ml of methanol and the mixture was further stirred for one hour. Crystals thus deposited were collected by filtration, washed with methanol, and dried to provide 6.1 g of the desired dye. The $\lambda_{max}$ of the aqueous solution of the dye was 621 nm, m.p.; 300° C. or more.

When the dye shown by formula (I) is used as a filter dye, an irradiation preventing dye, or an antihalation dye, an optional effective amount thereof can be used but it is preferred to use the dye so that the optical density is in the range of 0.05 to 3.0. The dye is used in an amount of from 1 to 500 mg/m$^2$ of hydrophilic colloid layer. The dye may be added to a hydrophilic colloid at any step before coating the colloid.

The dye of formula (I) for use in this invention can be dispersed in an emulsion layer or other hydrophilic colloid layer (e.g., an interlayer, a protective layer, an antihalation layer, or a filter layer) by various methods as described below.

(1) A method of directly dissolving or dispersing the dye in the coating composition for the emulsion layer or the hydrophilic colloid layer or a method of dissolving or dispersing the dye in an aqueous solution of a solvent and using the solution or the dispersion for the emulsion layer or the hydrophilic colloid layer. Examples of suitable solvents are methanol, ethanol, propanol, methyl cellosolve, the halogenated alcohols described in JP-A-48-9715 and U.S. Pat. No. 3,756,830, acetone, water, pyridine and a mixture thereof.

(2) A method of localizing a mordant represented by formula (II) or (III) shown below or a hydrophilic polymer as mordant in the emulsion layer or other hydrophilic colloid layer and localizing the dye into a specific layer by the coaction of the mordant and the dye molecule.

(3) A method of dissolving the dye in the coating composition for the emulsion layer or other hydrophilic colloid layer using a surface active agent. The surface active agent may be in the form of an oligomer or polymer.

The details of the surface active agents are described in JP-A-60-158437.

The hydrophilic colloid dispersion containing the dye of formula (I) for use in this invention and, as the case may be, a polymer mordant may further contain the hydrosol of an oleophilic polymer described, e.g., in JP-B-51-39835.

In one embodiment of this invention, a polymer mordant is used together with the dye of formula (I) described above for localizing dye in a specific layer as described above in method (2).

As the polymer mordant in this invention, polymers having secondary and tertiary amino groups, polymers having a nitrogen-containing heterocyclic moiety, and polymers having a quaternary cation group, each of these polymers having a molecular weight of above 5,000, and preferably above 10,000 are used.

Examples of these polymers are vinylpyridine polymers and vinylpyridinium cation polymers described in U.S. Pat. Nos. 2,548,564 and 3,148,061, JP-B-59-31696, vinylimidazolium cationic polymers described in U.S. Pat. No. 4,124,386, JP-B-55-29418, and JP-A-59-55436, polymer mordants capable of crosslinking with gelatin described in U.S. Pat. No. 3,625,694, aqueous sol type mordants described in U.S. Pat. No. 3,958,995 and JP-A-54-115228, reactive mordants capable of forming a conjugated bond with dyes described in U.S. Pat. No. 4,168,976, mordants having an ammonium structure described in U.S. Pat. Nos. 3,898,088 and 3,958,995, JP-A-49-121523 and 55-33172, polymers induced from an ethylenically unsaturated compound having a dialkylaminoalkyl ester residue described in British Patent No. 685,475, the products obtained by the reaction of polyvinyl alkyl ketone and aminoguanidine as described in British Patent No. 850,281, U.S. Pat. No. 2,582,156, JP-B-49-15820, and polymers induced from 2-methyl-1-vinylimidazole as described in U.S. Pat. No. 3,445,231. Especially, polymer mordant represented by formula (II) or (III) is preferably used.

The polymer mordants useful in this invention may be represented by formula (II) or (III) described below.

First, the polymer mordant of formula (II) is explained in detail.

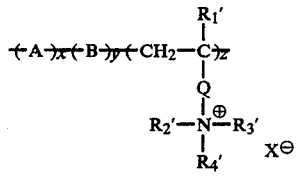

(II)

wherein A represents a monomer unit comprising a copolymerizable monomer having at least two copolymerizable ethylenically unsaturated groups, at least one of said groups being contained in a side chain of the monomer; B represents a monomer unit comprising a copolymerizable ethylenically unsaturated monomer; $R_1'$ represents a hydrogen atom, a lower alkyl group, or an aralkyl group; $R_2'$, $R_3'$, and $R_4'$, which may be the same or different, each represents a hydrogen atom, an alkyl group, an aryl group, or an aralkyl group, each of which may be substituted; Q represents a single bond, an alkylene group, a phenylene group, an aralkylene group, a

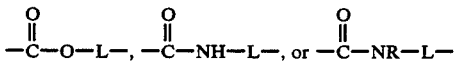

wherein L represents substituted or unsubstituted alkylene group, a substituted or unsubstituted arylene group, or a substituted or unsubstituted aralkylene group and R represents a substituted or unsubstituted alkyl group; two or more of Q, $R_2'$, $R_3'$, and $R_4'$ may combine with each other to form a single ring or composite ring structure containing at least one nitrogen atom; $X^{\ominus}$represents an anion; x represents from 0 to 60 mole %; y represents from 0 to 60 mole %; and z represents from 30 to 100 mole %.

In the preferred polymer mordants shown by formula (II), examples of the monomer unit A are divinylbenzene, ethylene glycol dimethacrylate, diethylene glycol dimethacrylate, triethylene glycol dimethacrylate, ethylene glycol diacrylate, diethylene glycol diacrylate, 1,6-hexanediol diacrylate, neopentyl glycol dimethacrylate, and tetramethylene glycol dimethacrylate. Among these monomers, divinylbenzene and ethylene glycol dimethacrylate are particularly preferred.

Examples of the monomer unit B are ethylene, propylene, 1-butene, isobutene, styrene, α-methylstyrene, vinyltoluene, a monoethylenically unsaturated ester of fatty acid (e.g., vinyl acetate and allyl acetate), an ethylenically unsaturated monocarboxylic acid or dicarboxylic acid amide (e.g., acrylamide, methacrylamide, N-methylacrylamide, N-tert-butylacrylamide, and N,N'-dibenzylmaleic acid diamide), an ethylenically unsaturated monocarboxylic acid or dicarboxylic acid ester (e.g., methyl methacrylate, ethyl methacrylate, n-butyl methacrylate, n-hexyl methacrylate, cyclohexyl methacrylate, benzyl methacrylate, n-butyl acrylate, n-hexyl acrylate, and 2-ethylhexyl acrylate), a monoethylenically unsaturated compound (e.g., acrylonitrile), and a diene (e.g., butadiene and isoprene). Among these monomers, styrene, n-butyl methacrylate and cyclohexyl methacrylate are particularly preferred.

B may include two or more kinds of the aforesaid monomer units.

$R_1'$ in formula (II) is preferably a hydrogen atom or a lower alkyl group having from 1 to 6 carbon atoms (e.g., methyl, ethyl, n-propyl, n-butyl, n-amyl, and n-hexyl) and is particularly preferably a hydrogen atom or a methyl group.

The aralkyl group for $R_1'$ includes an unsubstituted aralkyl group (e.g., benzyl, phenethyl, diphenyl, and naphthylmethyl) and a substituted aralkyl group such as an alkylaralkyl group (e.g., 4-methylbenzyl, 2,5-dimethylbenzyl, and 4-isopropylbenzyl), an alkoxyaralkyl group (e.g., 4-methoxybenzyl, 4-ethoxybenzyl, and 4-(4-methoxyphenyl)benzyl), a cyanoaralkyl (e.g., 4-cyanobenzyl and 4-(4-cyanophenyl)benzyl), a perfluoroalkoxyaralkyl group (e.g., 4-pentafluoropropoxybenzyl and 4-undecafluorohexyloxybenzyl), and a halogenated aralkyl group (e.g., 4-chlorobenzyl, 4-bromobenzyl, 3-chlorobenzyl, 4-(4-chlorophenyl)benzyl, and 4-(4-bromophenyl)benzyl).

$R_2'$, $R_3'$, and $R_4'$, which may be the same or different, each is preferably a hydrogen atom, an alkyl group having from 1 to 20 carbon atoms, an aryl group having from 6 to 20 carbon atoms, or an aralkyl group having from 7 to 20 carbon atoms. The alkyl group, aryl group and aralkyl group each may be substituted.

The alkyl group is preferably an unsubstituted alkyl group (e.g., methyl, ethyl, n-propyl, isopropyl, n-butyl, isobutyl, t-butyl, n-amyl, isoamyl, n-hexyl, cyclohexyl, n-heptyl, n-octyl, 2-ethylhexyl, n-nonyl, n-decyl, and n-dodecyl) and the carbon atom number of the alkyl group is preferably from 1 to 6, and more preferably from 1 to 4.

As the alkyl group, methyl, ethyl, propyl and isopropyl are particularly preferred.

Examples of the substituted alkyl group for $R_2'$, $R_3'$ and $R_4'$ are an alkoxyalkyl group (e.g., methoxymethyl, methoxyethyl, methoxybutyl, ethoxyethyl, ethoxypropyl, ethoxybutyl, butoxyethyl, butoxypropyl, butoxybutyl, and vinyloxyethyl), a cyanoalkyl group (e.g., 2-cyanoethyl, 3-cyanopropyl, and 4-cyanobutyl), a halogenated alkyl group (e.g., 2-fluoroethyl, 2-chloroethyl, and 3-fluoropropyl), an alkoxycarbonylalkyl group (e.g., ethoxycarbonylmethyl), an alkenylalkyl group (e.g., ethylcarbonylmethy and methylcarbonylethyl), an allyl group, a 2-butenyl group, and a propargyl group.

The aryl group for $R_2'$, $R_3'$ and $R_4'$ includes an unsubstituted aryl group (e.g., phenyl and naphthyl) and a substituted aryl group such as an alkyl aryl group (e.g., 2-methylphenyl, 3-methylphenyl, 4-methylphenyl, 4-ethylphenyl, 4-isopropylphenyl, and 4-tert-butylphenyl), an alkoxyaryl group (e.g., 2-methoxyphenyl, 3-methoxyphenyl, 4-methoxyphenyl, and 4-ethoxyphenyl), an aryloxyaryl group (e.g., 4-phenoxyphenyl), a cyanoaryl group (e.g., 4-cyanophenyl), and a halogenated aryl group e.g., 2-chlorophenyl, 3-chlorophenyl, 4-chlorophenyl, and 2,4-dibromophenyl).

The carbon atom number of the aryl group is preferably from 6 to 14, and more preferably from 6 to 10. A phenyl group is particularly preferred.

The aralkyl group for $R_2'$, $R_3'$ and $R_4'$ includes an unsubstituted aralkyl group (e.g., benzyl, phenethyl, diphenyl, and naphthylmethyl) and a substituted aralkyl group such as an alkylaralkyl group (e.g., 4-methylbenzyl, 2,5-dimethylbenzyl, and 4-isopropylbenzyl), an alkoxyaralkyl group (e.g., 4-methoxybenzyl, 4-ethoxybenzyl, and 4-(4-methoxyphenyl)benzyl), a cyanoaralkyl (e.g., 4-cyanobenzyl and 4-(4-cyanophenyl)benzyl), a perfluoroalkoxyaralkyl group (e.g., 4-pentafluoropropoxybenzyl and 4-undecafluorohexyloxybenzyl), and a halogenated aralkyl group (e.g., 4-chlorobenzyl, 4-bromobenzyl, 3-chlorobenzyl, 4-(4-chlorophenyl)-benzyl, and 4-(4-bromophenyl)benzyl).

The carbon atom number of the aralkyl group is preferably from 7 to 15, and more preferably from 7 to 11.

Among these aralkyl groups, benzyl and phenylethyl are particularly preferred.

Q in formula (II) is preferably a divalent alkylene group having from 1 to 12 carbon atoms (e.g., methylene or a group shown by $-(CH_2)_6-$), a phenylene group, or an aralkylene group having from 7 to 12 carbon atoms (e.g.,

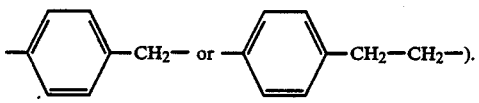

Also, Q may be a group shown by

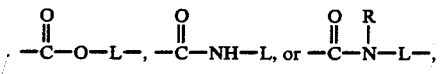

wherein L is preferably an alkylene group having from 1 to 6 carbon atoms, an arylene group having from 6 to 20 carbon atoms, or an aralkylene group having from 7 to 12 carbon atoms and R is preferably an alkyl group having from 1 to 6 carbon atoms.

The aforesaid alkylene group, aralkylene group, and arylene group and the alkyl group shown by R may be substituted or unsubstituted.

Also, two groups of Q, $R_2'$, $R_3'$, and $R_4'$ may combine with each other to form a ring structure containing at least one nitrogen atom and examples of the ring structure formed are a pyrrolidine ring, a piperidine ring, a morpholine ring, a pyridine ring, an imidazole ring, a quinuclidine ring, etc., and a pyrrolidine ring, a morpholine ring, a piperidine ring, an imidazole ring and a pyridine ring are preferred.

Furthermore, it is particularly preferred that one of $R_2'$, $R_3'$, and $R_4'$ is a hydrogen atom.

$X^{\ominus}$ represents an anion such as a halide ion (e.g., chloride ion and bromide ion), an alkylsulfonate or arylsulfonate ion (e.g., methanesulfonate ion, ethanesulfonate ion, benzenesulfonate ion, and p-toluenesulfonate ion), an acetate ion, a sulfate ion, and a nitrate ion. In these anions, a chloride ion, an acetate ion, a sulfate ion, and a nitrate ion are particularly preferred.

In formula (II), X is from 0 to 60 mole %, preferably from 5 to 40 mole %, and more preferably from 15 to 30 mole %; y is from 0 to 60 mole %, preferably from 0 to 40 mole %, and more preferably from 0 to 30 mole %; and z is from 30 to 100 mole %, preferably from 40 to 95 mole %, and more preferably from 50 to 85 mole %.

In a particularly preferred embodiment of the mordant shown by formula (II), at least one of $R_2'$, $R_3'$, and $R_4'$ is a hydrogen atom and x is from 5 to 60 mole %.

The polymer mordant of formula (II) for use in this invention can be generally obtained by copolymerizing the aforesaid copolymerizable monomer having at least two ethylenically unsaturated groups, the aforesaid ethylenically unsaturated monomer, and an unsaturated monomer shown by the formula below

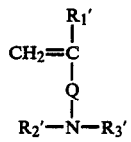

wherein $R_1'$, $R_2'$, $R_3'$, and Q are same as defined above in formula (II), (such as N,N-dimethylaminoethyl methacrylate, N,N-diethylaminoethyl methacrylate, N,N-dimethylaminoethyl acrylate, N-(N,N-dimethylaminopropyl) acrylamide, N-(N,N-dihexylaminomethyl)acrylamide, 3-(4-pyridyl)propyl acrylate, N,N-diethylaminomethylstyrene, 2-vinylpyridine, and 4-vinylpyridine, and particularly preferably N,N-diethylaminoethyl methacrylate, and N,N-diethylaminomethylstyrene), and then converting the product into an ammonium salt by reacting it with a compound having a structure of $R_4'$—X (wherein $R_4'$ and X are same as defined above) (such as hydrochloric acid, nitric acid, sulfuric acid, p-toluenesulfonic acid, acetic acid, methyl iodide, ethyl chloride, isopropyl bromide, and benzyl chloride).

Also, the polymer mordant shown by formula (II) can be obtained by copolymerizing the aforesaid copolymerizable monomer having at least two ethylenically unsaturated groups, the ethylenically unsaturated monomer, and an unsaturated monomer shown by the following formula

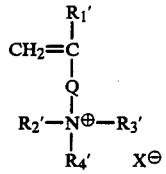

wherein $R_1'$, $R_2'$, $R_3'$, $R_4'$, X and Q are the same as defined above in formula (II) (such as N,N-dimethylaminoethyl methacrylate hydrochloride, N,N-diethylaminoethyl methacrylate sulfate, N,N-dimethylaminoethyl acrylate hydrochloride, N,N-diethylaminoethyl acrylate acetate, N-(N,N,N-trimethylamino-chloropyl)acrylamide chloride, N-(N,N,N-trihexylamino-methyl)acrylamide chloride, 3-(4-N-methylpyridyl)propyl acrylate, p-toluene sulfonate, N,N-diethylaminomethyl-styrene sulfate, 2-vinylpyridine hydrochloride, and 4-vinylpyridine hydrochloride, and particularly preferably N,N-diethylaminoethyl methacrylate acetate and N,N-diethylaminomethylstyrene sulfate).

Furthermore, the polymer mordant of formula (II) useful in this invention can be also obtained by copolymerizing the aforesaid copolymerizable monomer having at least two ethylenically unsaturated groups, the aforesaid ethylenically unsaturated monomer, and an unsaturated monomer shown by the following formula

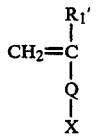

wherein $R_1'$, Q, and X are same as defined above in formula (II)) (such as β-chloroethyl methacrylate, β-p-toluenesulfonylethyl methacrylate, and chloromethylstyrene) and then converting the product into an ammonium salt by reacting it with an amine having the following formula

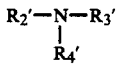

wherein $R_2'$, $R_3'$, and $R_4'$ are same as defined above in formula (II)) (such as dimethylamine, diethylamine, diisopropylamine, morpholine, piperidine, pyridine, trimethylamine, N-methylmorpholine, trihexylamine, and triethylamine).

The aforesaid polymerization reaction may be performed by solution polymerization, emulsion polymerization, suspension polymerization, precipitation polymerization or dispersion polymerization, but is preferably performed by solution polymerization or emulsion polymerization.

The aforesaid solution polymerization is performed in the presence of a radical polymerization initiator (e.g., a combination of potassium persulfate and sodium hydrogensulfite, commercially available products as V-50 and V-65, trade name, made by Wako Junyaku K.K.) at a temperature of from 30° C. to about 120° C., and preferably from 40° C. to about 100° C.

The aforesaid emulsion polymerization is performed in the presence of generally at least one emulsifier selected from an anionic surface active agent (e.g., sodium dodecylsulfate and Triton 770 (trade name, made by Rohm and Haas company)), a cationic surface active agent (e.g., Emulex NP-20 (trade name, made by Nippon Emulsion K.K.)), gelatin, polyvinyl alcohol, etc., and a radical polymerization initiator (e.g., a combination of potassium persulfate and sodium hydrogensulfite and a commercially available product as V-50 (trade name, made by Wako Junyaku K.K.)) at a temperature of from about 30° C. to about 100° C., and preferably from about 40° C. to about 80° C.

The aforesaid reaction of forming the ammonium salt is performed at a temperature of from about −10° C. to about 40° C., and preferably from about 0° C. to about 30° C.

The polymer mordant useful in this invention can be very easily produced in one reaction vessel throughout the whole production step.

Specific examples and synthesis examples of the polymer mordant of formula (II) for use in this invention are shown below but the invention is not limited to them.

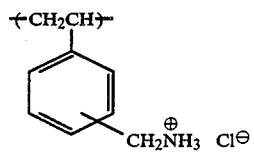

II-1

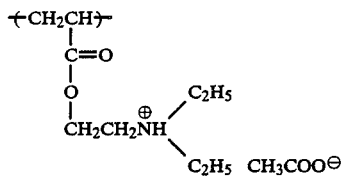

II-2

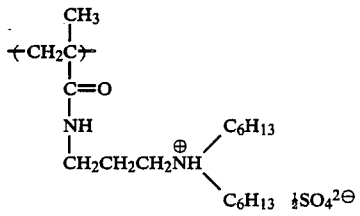

II-3

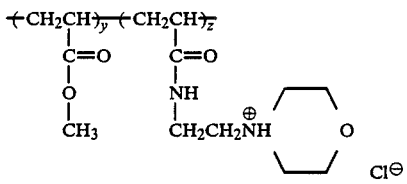

II-4 y:z = 10:90

-continued
II-5
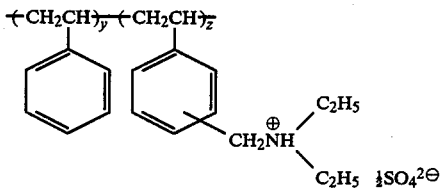
y:z = 30:70
II-6
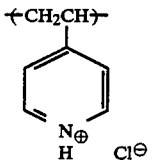
II-7
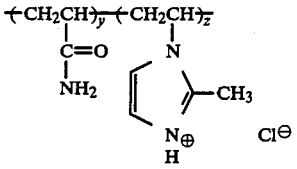
y:z = 50:50
II-8
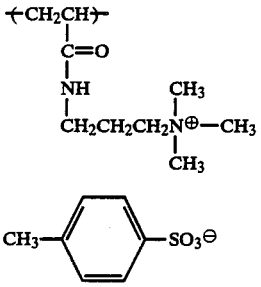
II-9
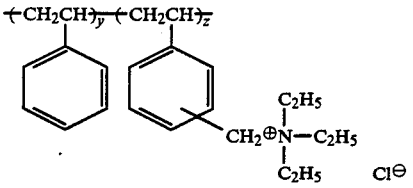
y:z = 45:55
II-10
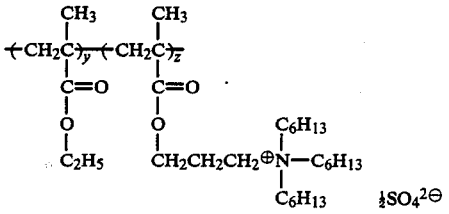
y:z = 30:70
II-11
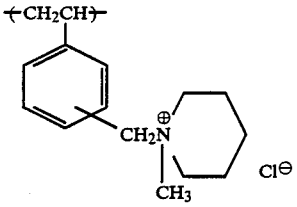

-continued
II-12
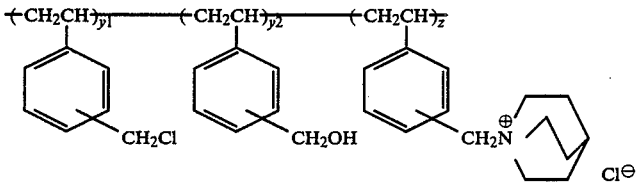
$y_1:y_2:z$ = 10:5:85
II-13
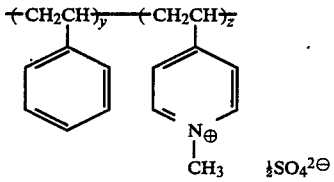
y:z = 25:75
II-14
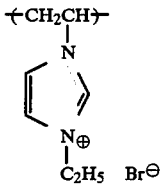
II-15
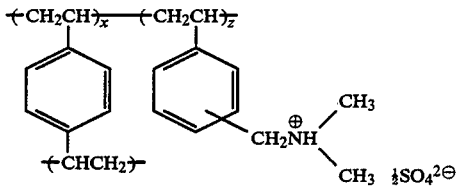
y:z = 15:85
II-16
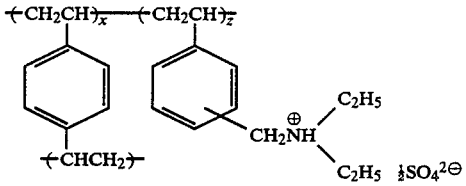
x:z = 20:80
II-17
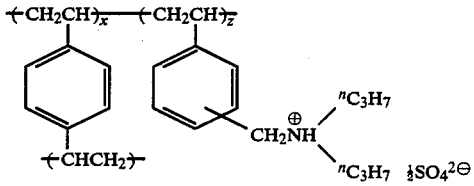
x:y = 30:70
II-18
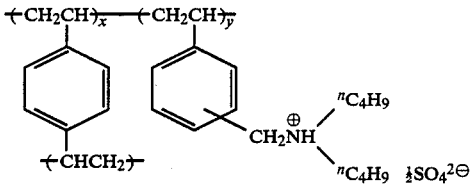
x:y = 20:80

-continued
II-19
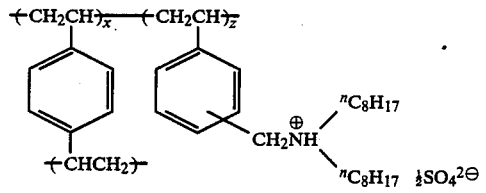
x:z = 20:80
II-20
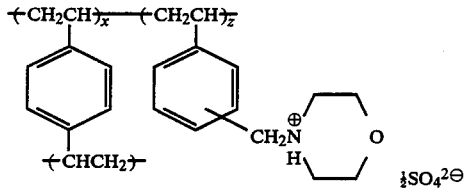
x:z = 20:80
II-21
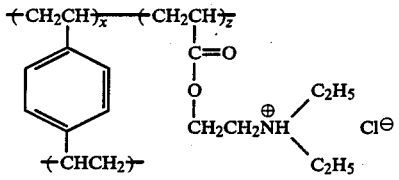
x:z = 10:90
II-22
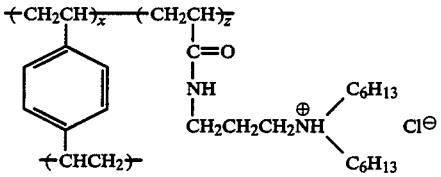
x:z = 10:90
II-23
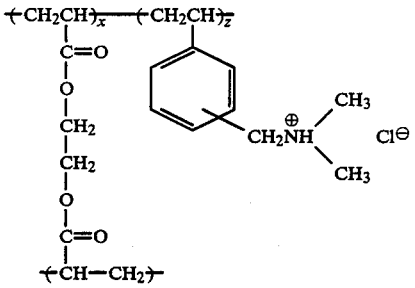
x:z = 15:85
II-24
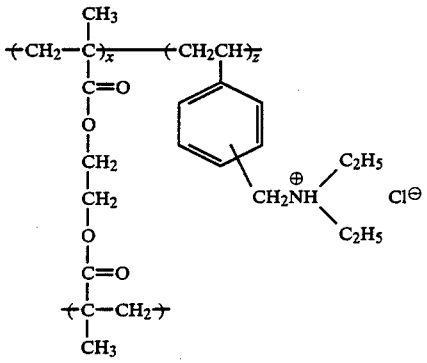
x:z = 15:85

-continued
II-25
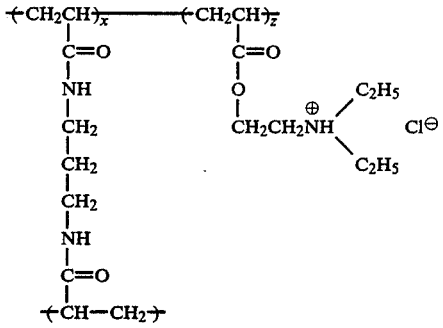
x:z = 15:85
II-26
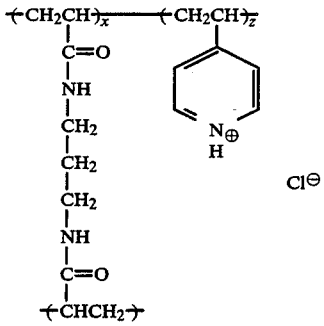
x:z = 15:85
II-27
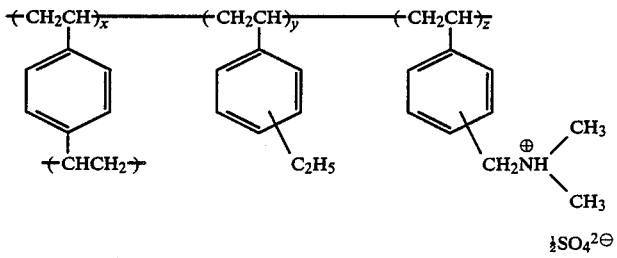
x:y:z = 10:10:80
II-28
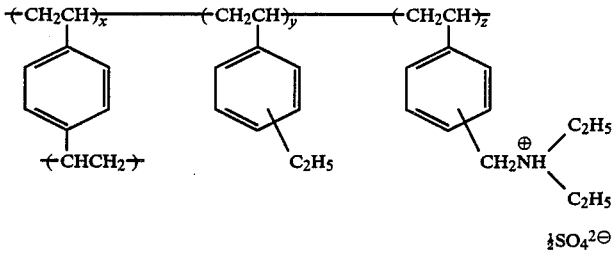
x:y:z = 10:10:80
II-29
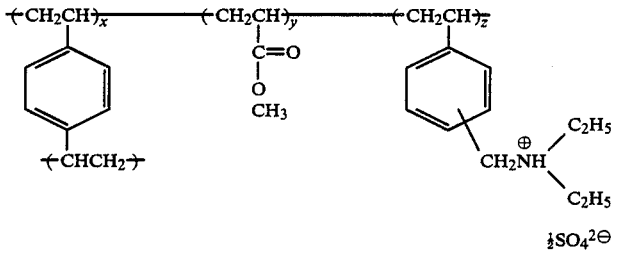
x:y:z = 10:10:80

-continued
II-30
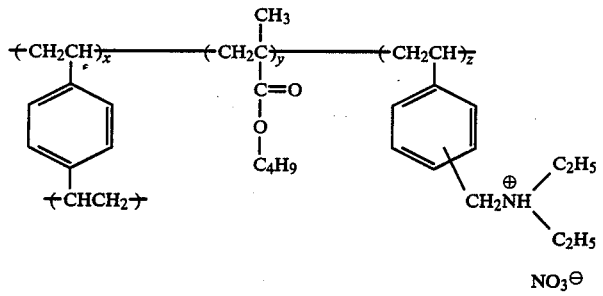
x:y:z = 45:5:50
II-31
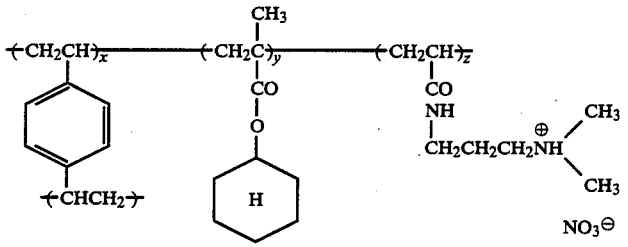
x:y:z = 25:15:60
II-32
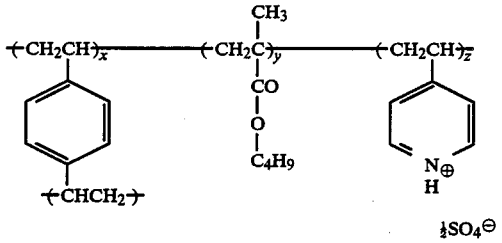
x:y:z = 20:10:70
II-33
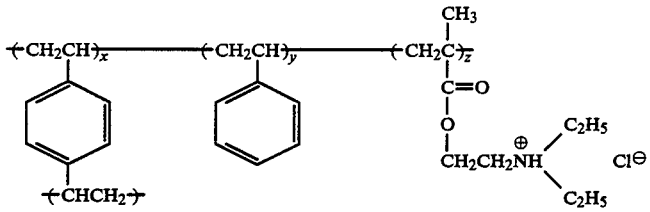
x:y:z = 15:5:80
II-34
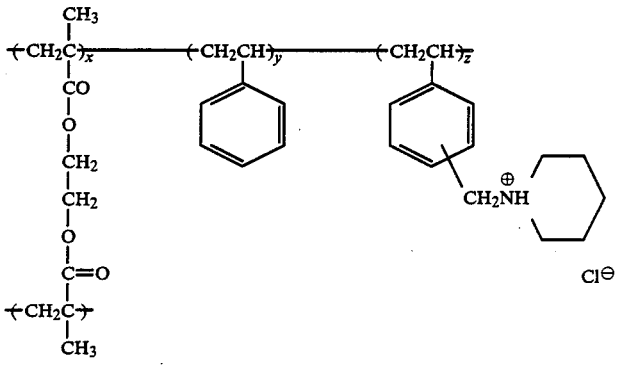
x:y:z = 40:10:50

-continued
II-35
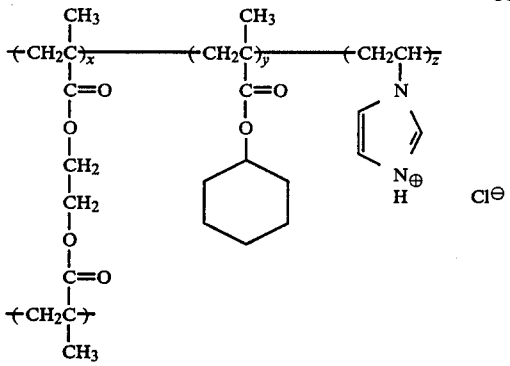
x:y:z = 25:25:50
II-36
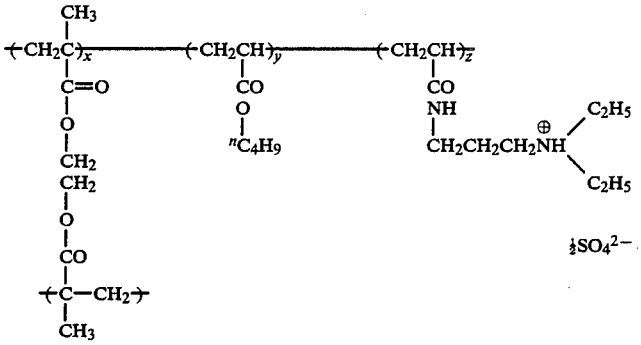
x:y:z = 25:10:65
II-37
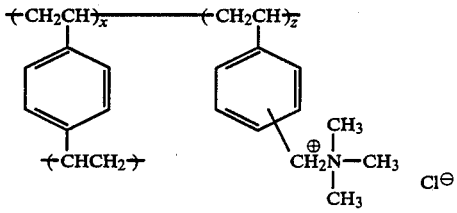
x:z = 10:90
II-38
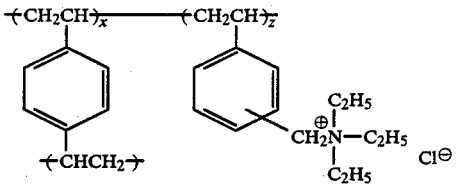
x:z = 25:75
II-39
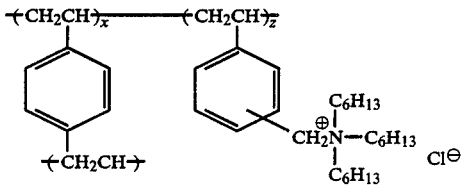
x:z = 33:67
II-40
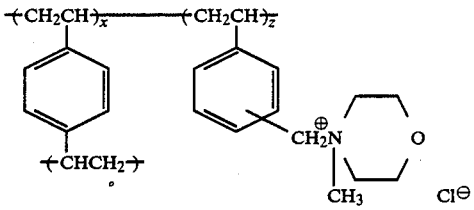
x:z = 10:90

-continued
II-41
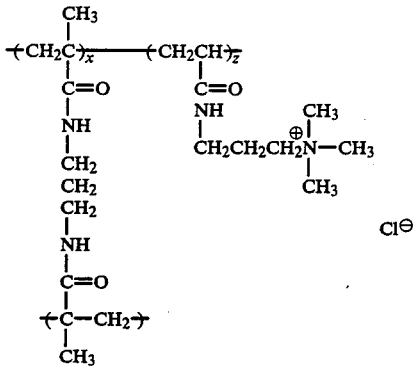
x:z = 20:80
II-42
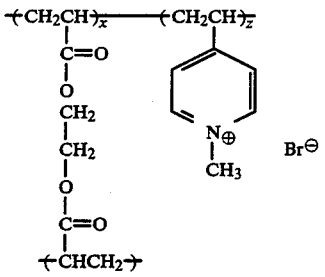
x:z = 20:80
II-43
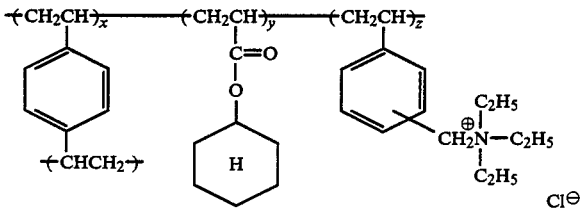
x:y:z = 20:20:60
II-44
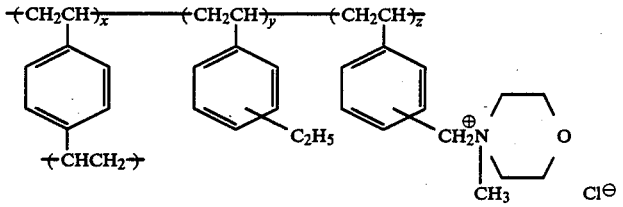
x:y:z = 5:47:48
II-45
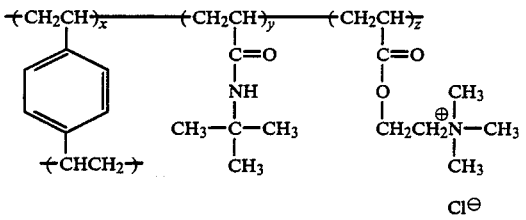
x:y:z = 10:40:50

-continued
II-46
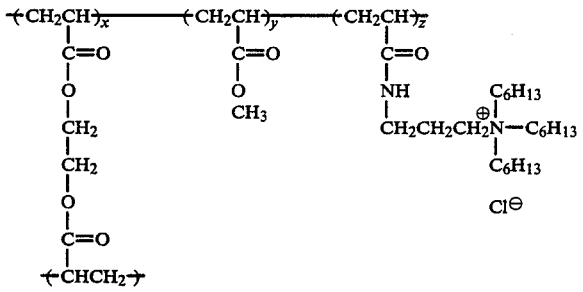
x:y:z = 10:10:80
II-47
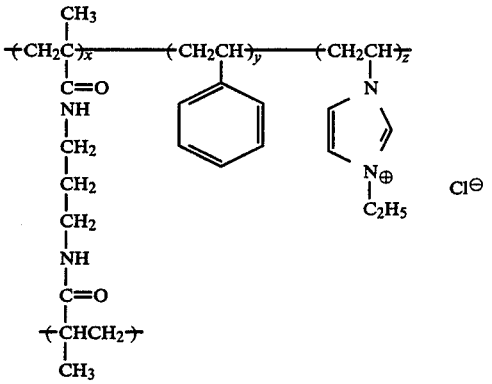
x:y:z = 5:25:70
II-48
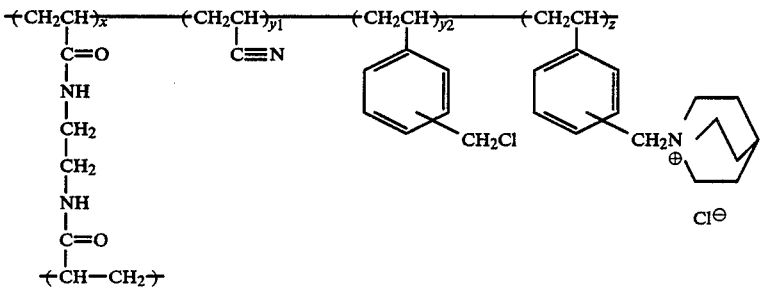
x:y1:y2:z = 10:10:7:73
II-49
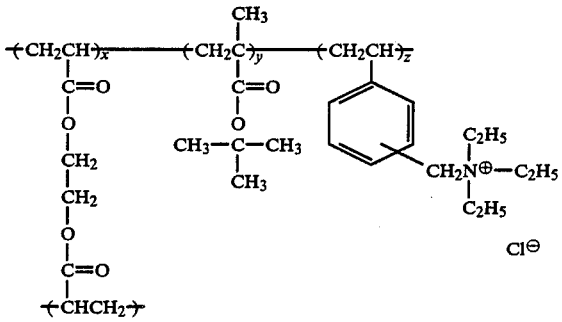
x:y:z = 30:35:35
II-50
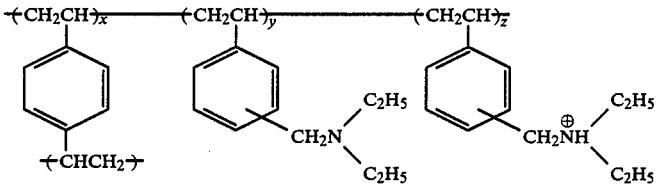
x:y:z = 15:20:65

-continued

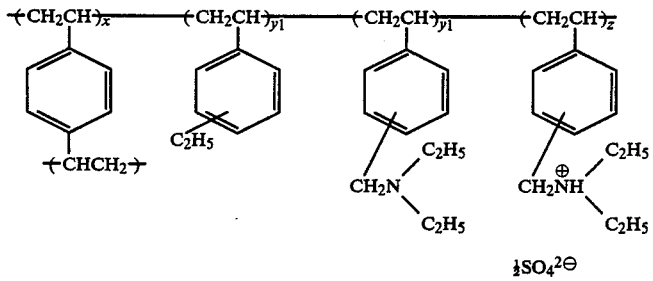

II-51 x:y1:y2:z = 20:5:15:60

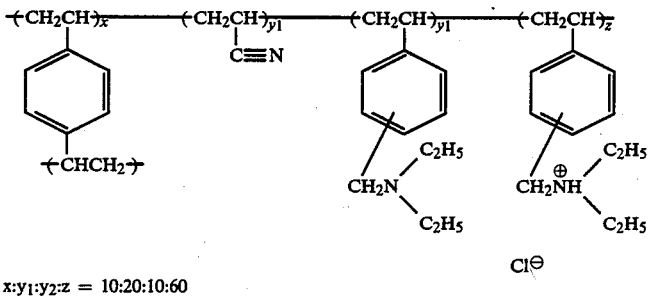

II-52 x:y1:y2:z = 10:20:10:60

SYNTHESIS EXAMPLE 1

Synthesis of poly(divinylbenzene-co-styrene-co-N,N-diethyl-N-methacryloyloxyethyl ammonium chloride) polymer dispersion (Mordant II-33)

In a reaction vessel was placed 108 g of distilled water and after degassing the water with nitrogen gas and heating it to 60° C. in nitrogen gas stream, 7.9 g of octadecyltrimethyl ammonium chloride (23%), 0.04 g of polyvinyl alcohol (saponification degree 95%), 0.78 g of styrene, 2.94 g of divinylbenzene, and 20.63 g of N,N-diethylaminoethyl methacrylate were added thereto followed by stirring.

Then, a solution of 0.44 g of potassium persulfate and 0.14 g of sodium hydrogensulfite dissolved in 10.8 g of distilled water degassed by nitrogen gas was added to the aforesaid mixture and the resultant mixture was stirred for about 5 hours. Thereafter, the reaction mixture was cooled to room temperature and after adding thereto a solution of 10.6 g of concentrated hydrochloric acid dissolved in 100 g of distilled water, the reaction mixture was filtered to provide a polymer dispersion having a solid component concentration of 14.0% by weight and a nitrogen content of $4.59\times10^{-4}$ eqv/g.

SYNTHESIS EXAMPLE 2

Synthesis of poly(divinylbenzene-co-diethylaminomethylstyrene hydrochloride) polymer dispersion (Mordant II-16)

In a reaction vessel was place 1100 g of distilled water and after degassing the water by nitrogen gas, 16.6 g of sodium dodecyl sulfate, 1.9 g of sodium hydroxide, 1.4 g of sodium sulfite, 33.6 g of divinylbenzene, and 195.7 of diethylaminomethylstyrene were added to the water followed by stirring.

After heating the mixture to 60° C., a solution of 0.9 g of potassium persulfate dissolved in 60 g of distilled water was added four times everyone hour and then the resultant mixture was further stirred for 2 hours. Thereafter, the reaction mixture was cooled to room temperature and after adding thereto a solution of 48.9 g of concentrated sulfuric acid in 313 g of distilled water, the mixture was filtered to provide a polymer dispersion having a solid component concentration of 15.4% by weight and a nitrogen content of $5.29\times10^{-4}$ eqv/g.

SYNTHESIS EXAMPLE 3

Synthesis of poly(ethyleneglycol dimethacrylate-co-t-butyl methacrylate-co-triethylamino-methylstyrene chloride) polymer dispersion (Mordant II—49)

In a reaction vessel were placed 2.8 g of an emulsifier, Nissan Trux H-45 (Nippon Oil and Fats Co., Ltd.), 75 g of distilled water, 5.95 g of ethylene glycol dimethacrylate, 4.98 g of butyl methacrylate, and 5.34 g of chloromethylstyrene and the mixture was stirred. After heating the mixture to 60° C., 0.2 g of a polymerization initiator commercially available as V-50 (trade name, made by Wako Junyaku K.K.) was added thereto followed by stirring for 3 hours. Thereafter, the reaction mixture was cooled to room temperature and 10 g of distilled water and 62 g of isopropyl alcohol were added thereto. Then, 3.49 g of triethylamine was added dropwise to the mixture over a period of 15 minutes and after stirring the mixture for 2 hours at 40° C., the mixture was filtered to provide a polymer dispersion having a solid component concentration of 8.46% by weight.

SYNTHESIS EXAMPLE 4

Synthesis of poly(N'-ethyl-N-vinylimidazolium bromide) solution (Mordant II—14)

In a reaction vessel was placed 100 g of dimethylacetamide and after degassing it with a nitrogen gas, 23.5 g of N-vinylimidazole was added thereto under nitrogen gas stream followed by stirring. After heating the mixture to 80° C., 0.6 g of a polymerization initiator commercially available of V-601 (trade name, made by Wako Junyaku K.K.) was added to the mixture, and after stirring the mixture for 4 hours, 0.6 g of V-601 was added again to the mixture followed by stirring. Then, after cooling the reaction mixture to about 40° C., 100 g of ethanol was added thereto. Then, 32.7 g of ethyl bromide was added dropwise to the mixture over a period of 30 minutes and the resultant mixture was stirred for 2 hours at 40° C. The solution obtained was poured into 3 liters of acetone and precipitates thus formed were collected by filtration, washed with 1 liter of acetone, and dried under reduced pressure at room temperature to provide 50.2 g of a solid polymer.

In another embodiment of this invention, the polymer mordant represented by the following formula (III) can also be used together with the dye of formula (I) described above.

The polymer mordant shown by formula (III) is described in detail below.

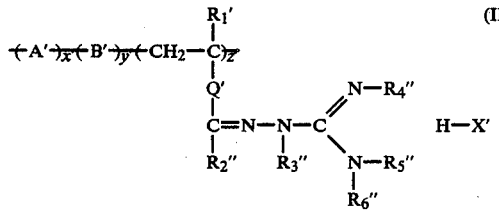

(III)

wherein A′ represents a monomer unit comprising a copolymerizable monomer having at least two copolymerizable ethylenically unsaturated groups, at least one of said groups being bonded to a side chain of the monomer; B′ represents a monomer unit comprising a copolymerizable ethylenically unsaturated monomer; $R_1''$ represents a hydrogen atom, a lower alkyl group, or an aralkyl group; $R_2''$, $R_3''$, $R_4''$, $R_5''$, and $R_6''$, which may be the same or different, each represents a hydrogen atom, an alkyl group, an aryl group, or an aralkyl group, each of which may be substituted; Q′ represents a single bond, an alkylene group, a phenylene group, an aralkylene group,

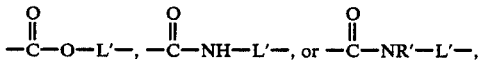

wherein L′ represents a substituted or unsubstituted alkylene group, a substituted or unsubstituted arylene group, or a substituted or unsubstituted aralkylene group and R′ represents a substituted or unsubstituted alkyl group; two or more of Q′, $R_2''$, $R_3''$, $R_4''$, $R_5''$, and $R_6''$ may combine with each other to form a ring structure containing at least one nitrogen atom; H—X′ represents a proton acid material; x′ represents from 0 to 60 mole %, y′ represents from 0 to 60 mole %, and z′ represents from 30 to 100 mole %.

In a preferred embodiment of the polymer mordant represented by formula (III), examples of the monomer unit A′ are divinylbenzene, ethylene glycol dimethacrylate, diethylene glycol dimethacrylate, triethylene glycol dimethacrylate, ethylene glycol diacrylate, diethylene glycol diacrylate, 1,6-hexanediole diacrylate, neopentyl glycol, dimethacrylate, and tetramethylene glycol dimethacrylate and are particularly preferably divinylbenzene and ethylene glycol dimethacrylate.

Examples of the ethylenically unsaturated monomer unit B′ are ethylene, propylene, 1-butene, isobutene, styrene, α-methylstyrene, vinyltoluene, a monoethylenically unsaturated ester of fatty acid (e.g., vinyl acetate and allyl acetate), an ethylenically unsaturated monocarboxylic acid or dicarboxylic acid amide (e.g., acrylamide, methacrylamide, N-methylacrylamide, N-tert-butylacrylamide, and N,N′-dibenzylmaleic acid diamide), an ethylenically unsaturated monocarboxylic acid or dicarboxylic acid ester (e.g., methyl methacrylate, ethyl methacrylate, n-butyl methacrylate, n-hexyl methacrylate, cyclohexyl methacrylate, benzyl methacrylate, n-butyl acrylate, n-hexyl acrylate, and 2-ethylhexyl acrylate), a monoethylenically unsaturated compound (e.g., acrylonitrile, methyl vinyl ketone, ethyl vinyl ketone), and a diene (e.g., butadiene and isoprene) and are particularly preferably styrene, n-butyl methacrylate, cyclohexyl methacrylate, and methyl vinyl ketone. B′ may contain two or more kinds of the aforesaid monomer units.

$R_1''$ is preferably a hydrogen atom or a lower alkyl group having from 1 to 6 carbon atoms (e.g., methyl, ethyl, n-propyl, n-butyl, n-amyl, and n-hexyl) and is particularly preferably a hydrogen atom or a methyl group.

The aralkyl group for $R_1''$ includes an unsubstituted aralkyl group (e.g., benzyl, phenethyl, diphenylmethyl, and naphthylmethyl) and a substituted aralkyl group such as an alkylaralkyl group (e.g., 4-methylbenzyl, 2,5-dimethylbenzyl, and 4-isopropylbenzyl), an alkoxyaralkyl group (4-methoxybenzyl, 4-ethoxybenzyl, and 4-(4-methoxyphenyl)benzyl), a cyanoaralkyl group (e.g., 4-cyanobenzyl and 4-(4-cyanophenyl)benzyl), a perfluoroalkoxyaralkyl group (e.g., 4-pentafluoropropoxybenzyl, and 4-undecafluorohexyloxybenzyl), and a halogenated aralkyl group (e.g., 4-chlorobenzyl, 4-bromobenzyl, 3-chlorobenzyl, 4-(4-chlorophenyl)benzyl, and 4-(4-bromophenyl)benzyl).

$R_2''$, $R_3''$, $R_4''$, $R_5''$, and $R_6''$ each is preferably a hydrogen atom, an alkyl group having from 1 to 20 carbon atoms, an aryl group having from 6 to 20 carbon atoms, or an aralkyl group having from 7 to 20 carbon atoms. These alkyl groups, aryl groups, and aralkyl groups may be substituted.

The alkyl group for $R_2''$ to $R_6''$ is preferably an unsubstituted alkyl group (e.g., methyl, ethyl, n-propyl, isopropyl, n-butyl, isobutyl, t-butyl, n-amyl, isoamyl, n-hexyl, cyclohexyl, n-heptyl, n-octyl, 2-ethylhexyl, n-nonyl, n-decyl, and n-dodecyl) and the carbon atom number of the alkyl group is preferably from 1 to 6.

More preferably, the number of carbon atoms of the alkyl group is from 1 to 4, and methyl, ethyl, isopropyl, and n-propyl are particularly preferred. Also, $R_2''$ is particularly preferably methyl or ethyl.

The substituted alkyl group for $R_2''$ to $R_6''$ includes an alkoxyalkyl group (e.g., methoxymethyl, methoxyethyl, methoxybutyl, ethoxyethyl, ethoxypropyl, ethoxybutyl, butoxyethyl, butoxypropyl, butoxybutyl and vinyloxyethyl), a cyanoalkyl group (e.g., 2-cyanoethyl, 3-cyanopropyl, and 4-cyanobutyl), a halogenated alkyl group (e.g., 2-flouroethyl, 2-chloroethyl, and 3-fluoropropyl), an alkoxycarbonylalkyl group (e.g., ethoxycarbonylmethyl), an alkenylalkyl group (e.g., ethylcarbonylmethyl and methylcarbonylethyl), an allyl group, a 2-butenyl group, and a porpanyl group.

Suitable aryl groups, preferably include an unsubstituted aryl group (e.g., phenyl and naphthyl) and a substituted aryl group such as an alkylaryl group (e.g., 2-methylphenyl, 3-methylphenyl, 4-methylphenyl, 4-ethylphenyl, 4-isopropyl-phenyl, and 4-tert-butylphenyl), an alkoxyaryl group (e.g., 2-methoxyphenyl, 3-methoxyphenyl, 4-methoxyphenyl, and 4-ethoxyphenyl), an aryloxyaryl group (e.g., 4-phenoxyphenyl), a cyanoaryl group (e.g., 4-cyanophenyl), a halogenated aryl group (e.g., 2-chlorophenyl, 3-chlorophenyl, 4-chlorophenyl, and 2,4-dibromophenyl), etc. The carbon atom number of the aryl group is preferably from 6 to 14, and more preferably from 6 to 10. A particularly preferred aryl group is a phenyl group.

Suitable aralkyl groups for $R_2''$ to $R_6''$ preferably includes an unsubstituted aralkyl group (e.g., benzyl, phenethyl, diphenylmethyl, and naphthylmethyl) and a substituted aralkyl group such as an alkylaralkyl group (e.g., 4-methylbenzyl, 2,5-dimethylbenzyl, and 4-isopropylbenzyl), an alkoxyaralkyl group (4-methoxybenzyl, 4-ethoxybenzyl, and 4-(4-methoxyphenyl)benzyl), a cyanoaralkyl group (e.g., 4-cyanobenzyl and 4-(4-cyanophenyl)benzyl), a perfluoroalkoxyaralkyl group (e.g., 4-pentafluoropropoxybenzyl, and 4-undecafluorohexyloxybenzyl), and a halogenated aralkyl group (e.g., 4-chlorobenzyl, 4-bromobenzyl, 3-chlorobenzyl, 4-(4-chlorophenyl)benzyl, and 4-(4-bromophenyl)benzyl). The carbon atom number of the aralkyl group is preferably from 7 to 15, and more preferably from 7 to 11.

Among these aralkyl groups, benzyl and phenylethyl are particularly preferred.

Furthermore, it is preferred that the carbon atom number of each of the groups of $R_3''$, $R_4''$, $R_5''$, and $R_6''$ is simultaneously from 1 to 4 and is particularly 1 or 2. Also, it is particularly preferred that at least one of $R_3''$, $R_4''$, $R_5''$, and $R_6''$ is a hydrogen atom. It is very preferred that each of $R_3''$, $R_4''$, $R_5''$, and $R_6''$ is a hydrogen atom.

Q' in formula (III) is preferably a divalent alkylene group having from 1 to 12 carbon atoms (e.g., methylene and $-(CH_2)_6-$), a phenylene group, or an aralkylene group having from 7 to 12 carbon atoms (e.g.,

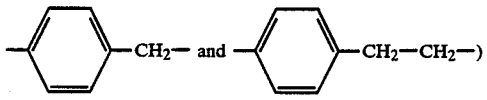

and also is preferably

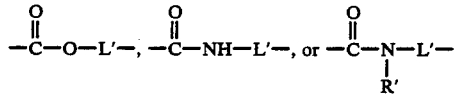

wherein L' preferably represents an alkylene group having from 1 to 6 carbon atoms, an arylyene group having from 6 to 20 carbon atoms, or an aralkylene group having from 7 to 12 carbon atoms and R' preferably represents an alkyl group having from 1 to 6 carbon atoms.

The aforesaid alkylene group, aralkylene group, and arylene group for L', and the alkyl group shown by R' may be substituted or unsubstituted. Q' is preferred to be a single bond.

Also, two or more groups of Q', $R_2''$, $R_3''$, $R_3''$, $R_4''$, and $R_6''$ may combine with each other to from a ring structure containing at least one nitrogen atom(s) and the cyclic structure is particularly preferably a 6-membered or 5-membered ring.

H—X' represents a proton acid material such as hydrogen chloride, hydrogen bromide, hydrogen iodide, sulfuric acid, nitric acid, acetic acid, oxalic acid, methanesulfonic acid, ethanesulfonic acid, benzenesulfonic acid, p-toluenesulfonic acid, etc., and hydrogen chloride, acetic acid, sulfuric acid, and nitric acid are particularly preferred.

Also, x' is from 0 to 60 mole %, preferably from 0 to 40 mole %, and more preferably from 0 to 30 mole %, y' is from 0 to 60 mole %, preferably from 0 to 40 mole %, and more preferably from 0 to 30 mole %, and z' represents from 30 to 100 mole %, preferably from 40 to 95 mole %, and more preferably from 50 to 85 mole %.

The polymer mordant of by formula (III) useful in this invention can be obtained by copolymerizing the aforesaid polymerizable monomer having at least two ethylenically unsaturated groups, the aforesaid ethylenically unsaturated monomer and an unsaturated monomer shown by the following formula

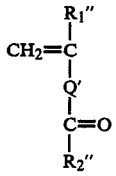

wherein $R_1''$, $R_2''$, and Q' are the same as defined above in formula (III) (e.g., methyl vinyl ketone, methyl-(1-methylvinyl) ketone, ethyl vinyl ketone, ethyl-(1-methylvinyl) ketone, n-propylvinyl ketone, diacetoneacrylamide, and diacetone acrylate, and particularly preferably methyl vinyl ketone, ethyl vinyl ketone, diacetoneacrylamide, and diacetone acrylate), reacting the product and a compound shown by the following formula

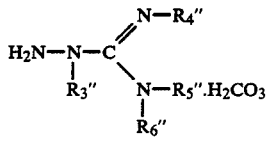

wherein $R_3''$, $R_4''$, $R_5''$, and $R_6''$ are the same as defined above in formula (III) (e.g., aminoguanidine hydrogencarbonate, N-amino-N-methyl-guanidine hydrogencarbonate, and N-amino-N'-methyl-quanidine hydrogencarbonate, particularly preferably aminoguanidine hydrogencarbonate), and then further converting the product into a guanidium salt by reacting it with a compound shown by the following formula

H—X' wherein H—X' is same as defined above in formula (III) (e.g., hydrogen chloride, hydrogen bromide, sulfuric acid, acetic acid, and nitric acid).

The aforesaid polymerization reaction may be performed by solution polymerization, emulsion polymerization, suspension polymerization, precipitation polymerization, or dispersion polymerization and is preferably by a solution polymerization or emulsion polymerization.

The solution polymerization is performed in the presence of a radical polymerization initiator (e.g., a combination of potassium persulfate and sodium hydrogensulfite and commercially available products as V-50 and V-65, trade name, made by Wako Junyaku K.K.) at a temperature of from 30° C. to about 120° C., and preferably from 40° C. to about 100° C.

The aforesaid emulsion polymerization is performed in the presence of at least one of an emulsifier selected from an anionic surface active agent (e.g., sodium dodecylsulfate and Triton 770 (trade name, made by Rohm & Haas Company)), a cationic surface active agent (e.g., octedecyltrimethyl ammonium chloride), a nonionic surface active agent (e.g., Emulex NP-20 (trade name, made by Nippon Emulsion K.K.), gelatin, and polyvinyl alcohol and a radical polymerization initiator (e.g., a combination of potassium persulfate and sodium hydrogensulfite) at temperature of from 30° C. to about 100° C., and preferably from 40° C. to about 80° C.

The aforesaid reaction with the aminoguanidine hydrogencarbonates is performed at a temperature of from −10° C. to about 50° C., and particularly preferably from 0° C. to about 30° C.

Also, the aforesaid reaction of forming a guanidium salt by reacting it with the proton acid material is performed at a temperature of from −10° C. to about 40° C., and preferably from 0° C. to about 30° C.

The polymer mordant of formula (III) useful in this invention can be also produced very easily in one reaction vessel throughout the whole production step.

Specific examples of the polymer mordant of formula (III) are illustrated below but the invention is not limited to them.

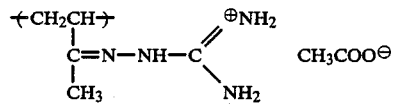

III-1

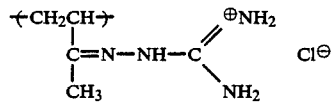

III-2

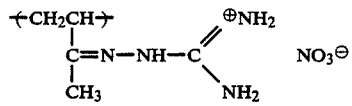

III-3

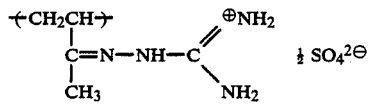

III-4

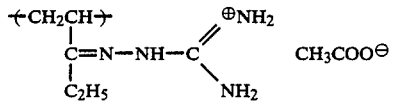

III-5

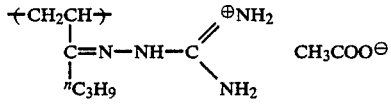

III-6

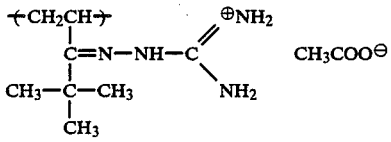

III-7

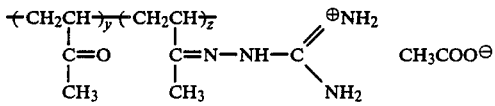

y:z = 40:60

III-8

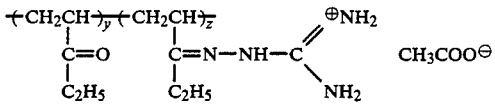

y:z = 20:80

III-9

-continued
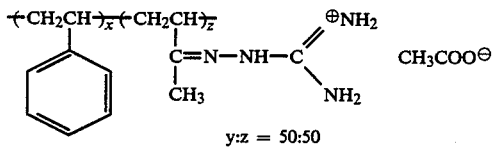
y:z = 50:50
III-10
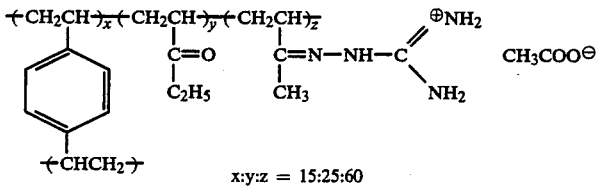
x:y:z = 15:25:60
III-11
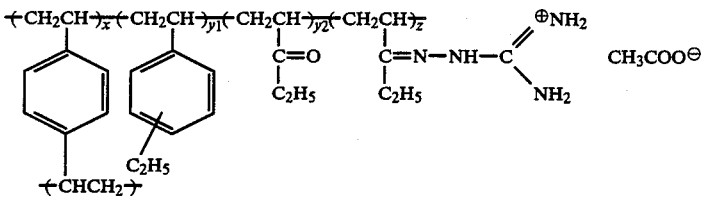
x:y1:y2:z = 20:5:25:50
III-12
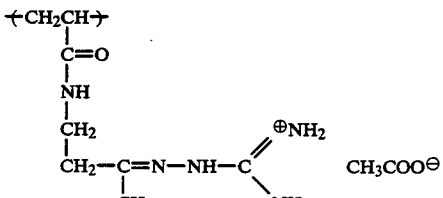
III-13
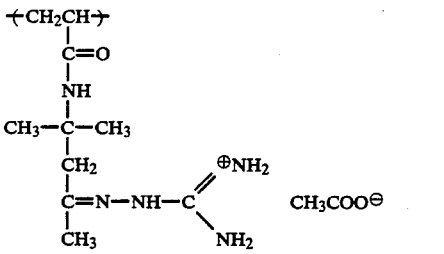
III-14
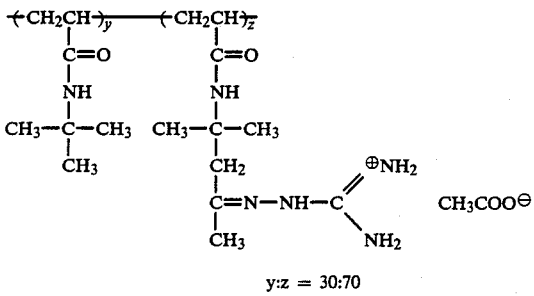
y:z = 30:70
III-15

-continued
III-16
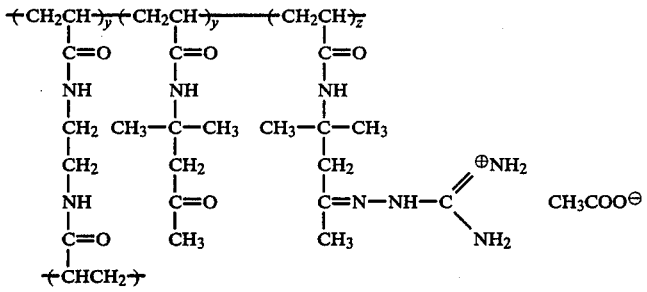
x:y:z = 10:45:45
III-17
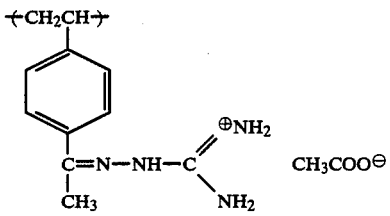
III-18
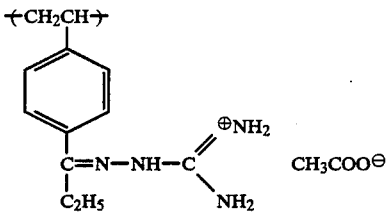
III-19
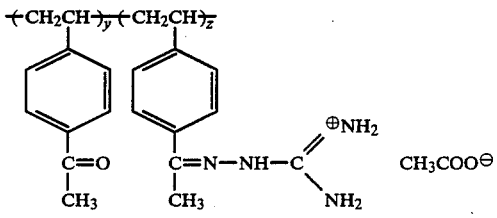
x:z = 50:50
III-20
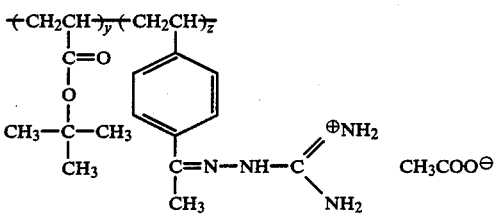
y:z = 30:70
III-21
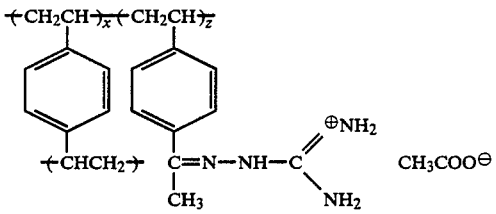
x:z = 10:90

-continued

III-22

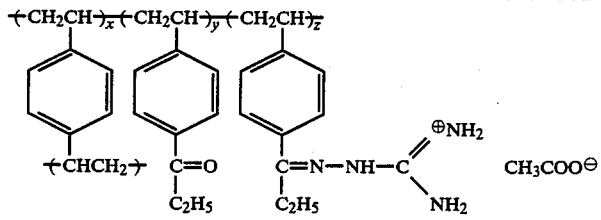

x:y:z = 15:30:55

III-23

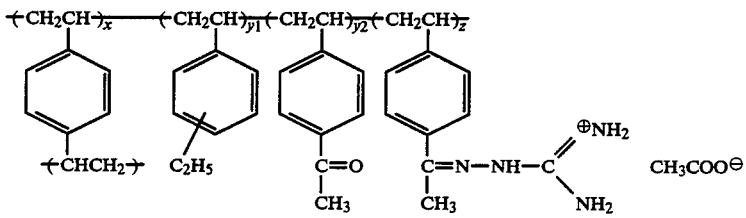

$x:y_1:y_2:z$ = 20:5:20:55

III-24

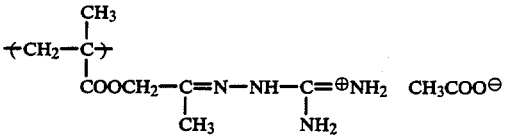

Compounds III-1 to III-10 described above can be synthesized by the methods described in U.S. Pat. Nos. 2,882,156 and 3,282,699 or methods similar to these methods. Compounds III-13 to III-15 can be synthesized by the methods disclosed in British Patent Nos. 1,381,263 and 1,381,264 and JP-A-47-13935. Furthermore, Compounds III-17 to III-20 can be synthesized by the methods described in British Patent No. 3,740,228. Also, the compounds other than the aforesaid compounds can be also synthesized by combining the aforesaid synthesis methods and the synthesis methods described in JP-A-55-33172.

Gelatin is typical as the hydrophilic colloid for use in this invention, but other hydrophilic colloid which are known to be used for photographic materials can also be used.

The dye of formula (I) for use in this invention is used preferably in an amount of from 0.1 mg to 500 mg, more preferably from 0.5 mg to 200 mg and most preferably from 2 mg to 100 mg per $m^2$ of hydrophlic colloidal layer. The mordant of formula (II) or (III) for use in this invention is used preferably in an amount of from 0.1 mg to 100 mg, more preferably from 1 mg to 500 mg and most preferably from 5 mg to 250 mg per $m^2$ of hydrophlic colloid layer.

The silver halide emulsion useful in this invention may comprise of silver bromide, silver iodobromide, silver iodochloro-bromide silver chlorobromide or silver chloride.

The silver halide grains useful in this invention may have a regular crystal for such as cubic and octahedral, an irregular crystal form such as spherical, tabular, etc., or may be a composite form of these crystal forms. Also, a mixture of silver halide grains having various crystal forms can be used in this invention but silver halide grains having a regular crystal form are preferred.

The silver halide grains useful in this invention may have different phases between the interior and the surface layer thereof or may have a homogeneous phase throughout the grains. Also, the silver halide grains may be of the type that forms latent images mainly on the surface thereof (e.g., negative-working emulsion) or of the type that mainly forms latent images in the interior thereof (e.g., internal latent image type emulsion or previously fogged direct reversal type emulsion). The silver halide grains of the type mainly forming latent images on the surface thereof are preferred.

The silver halide emulsion useful in this invention is preferably a tabular grain silver halide emulsion wherein silver halide grains having a thickness of less than 0.5 micron, and preferably less than 0.3 micron, a diameter of preferably larger than 0.6 micron, and a mean aspect ratio of at least 5, account for at least 50% of the total projected area, or a monodispersed silver halide emulsion wherein the statistic coefficient of variation (the value $(S/\bar{d})$ of the standard deviations in the case of approximating the projected area to circle divided by the diameter $\bar{d}$). Also, a mixture of two or more kinds of the tabular grain silver halide emulsions and the monodispersed silver halide emulsions can be used in this invention.

The photographic silver halide emulsions useful in this invention can be prepared by the methods described in P. Glafkides, *Chimie et Physique Photographique*, Paul Montel, 1967, G. F. Duffin, *Photographic Emulsion Chemistry*, Focal Press, 1966, and V. L. Zelikman, *Making and Coating Photographic Emulsion*, Focal Press, 1964.

At the formation of silver halide grains, a silver halide solvent such as ammonia, potassium thiocyanate, ammonium thiocyanate, thioether compounds (described in U.S. Pat. Nos. 3,271,157, 3,574,628, 3,704,130 4,297,439 , and 4,276,374), thione compounds (described in JP-A-53-144319, 53-82408, and 55-77737), and amine compounds (described in JP-A-54-100717) can be added.

In the step of the formation and physical ripening of silver halide grains, a cadmium salt, a zinc salt, a thallium salt, an iridium salt or a complex salt thereof, a rhodium salt or a complex salt thereof, an iron salt or a complex salt thereof, etc., may be present.

The silver halide emulsion useful in this invention is usually chemically sensitized. For example the chemical sensitization methods described in H. Frieser, *Die Grundlagen Der Photographischen Prozesse mit Silberhalogeniden*, Akademische Foerlungsgeselshaft, (1968), pages 675–734 can be used.

For example, a sulfur sensitization method using active gelatin or a sulfur-containing compound capable of reacting with silver (e.g., thiosulfates, thioureas, mercapto compounds, rhodanines), a reduction sensitizing method using a reducing material (e.g., stannous salts, amines, hydrazine derivatives, formamidinesulfinic acid, silane compounds), and a noble metal sensitizing method using a noble metal compound (e.g., gold complex salts and complex salts of a metal corresponding to Group VIII of the periodic table, such as Pt, It, Pd, etc.) can be used solely or as a combination thereof.

The silver halide photographic emulsions useful in this invention can contain various compounds for preventing the formation of fog during the production, storage, and photographic processing of photographic light-sensitive materials. There are various compounds known as antifoggants or stabilizers useful for this purpose such as azoles (e.g., benzothiazolium salts, nitroindazoles, triazoles, benzotriazoles, and benzimidazoles (in particular, nitro- or halogen-substituted benzimidazoles), heterocyclic mercapto compounds (e.g., mercaptothiazoles, mercaptobenzothiazoles, mercaptobenzoimidazoles, mercaptobenzothiadiazole, mercaptotetrazoles (in particular, 1-phenyl-5-mercaptotetrazole), and mercaptopyrimidines, the aforesaid heterocyclic mercapto compounds having a watersolubilizing group such as a carboxy group and a sulfon group, thioketo compounds (e.g., oxazolinethione), azaindenes [e.g., tetraazaindenes (in particular, 4-hydroxy-substituted(1,3,3a,7)tetraazaindenes), benzenethiosulfonic acids, and benzenesulfinic acid.

The silver halide photographic emulsions useful in this invention can further contain color couplers such as a cyan coupler, a magenta coupler, and a yellow coupler and also the compounds for dispersing the couplers.

That is, the silver halide emulsion may contain a compound capable of coloring by causing oxidative coupling with an aromatic primary amine developing agent (e.g., phenylenediamine derivatives and aminophenol derivatives) in color development. For example, as a magenta coupler, there are 5-pyrazolone couplers, pyrazolobenzimidazole couplers, cyanoacetyl coumarone couplers, pyrazolotriazole couplers, and open chain acylacetonitrile couplers. As a yellow coupler, there are acylacetamide couplers (e.g., benzoylacetanilides and pivaloylacetanilides). Also, as a cyan coupler, there are naphthol couplers and phenol couplers.

These couplers are preferably non-diffusible couplers having a hydrophobic group called as ballast group in the molecule.

The couplers may be 4-equivalent or 2-equivalent to silver ions. Also, the couplers may be colored couplers having a color correction effect or couplers releasing a development inhibitor upon development (so-called DIR couplers).

Also, in place of DIR couplers, non-coloring DIR compounds which give a colorless product by coupling reaction and release a development inhibitor may be used.

The silver halide photographic emulsions useful in this invention may contain polyalkylene oxide or the derivatives thereof, such as the ethers, esters, amines, etc., thereof, thioether compounds, thiomorpholines, quaternary ammonium salt compounds, urethane derivatives, urea derivatives, imidazole derivatives, 3-pyrazolidones, etc., for increasing the sensitivity, increasing the contrast, or accelerating the development.

The silver halide photographic emulsions useful in this invention may contain, together with the dyes of formula (I) described above, known water-soluble dyes (e.g., oxonol dyes, hemioxonol dyes, and merocyanine dyes) as filter dyes or for irradiation prevention, etc. Also, the emulsions may further contain cyanine dyes, merocyanine dyes, or hemicyanine dyes as a spectral sensitizing dye together with the dyes of formula (I).

The silver halide photographic emulsions useful in this invention may contain various surface active agents for various purposes such as coating aid, static prevention, improvement of slidability, improvement of emulsion-dispersibility, sticking prevention, and improvement of photographic characteristics (e.g., development acceleration, increase of contrast, and sensitization).

Also, the photographic light-sensitive materials of this invention may contain various additives such as fading preventing agents, hardening agents, color fog preventing agents, ultraviolet absorbents, protective colloids such as gelatin, etc., and these additives are practically described, e.g., in *Research Disclosure*, Vol. 176 (RD-17643), (Dec., 1978).

In addition, examples of the preferred hardening agent are N-carbamoylpyridinium salts such as bis(-vinylsulfonylmethyl)ether, (1-morpholinocarbonyl-3-pyridinio)methane sulfonate, etc., and haloamidinium salts such as 1-(1-chloro-1-pyridinomethylene)pyrrolidinium 2-naphthalenesulfonate, etc.

A finished silver halide emulsion is coated on suitable support such as a baryta-coated paper, a resin-coated paper, a synthetic paper, a cellulose triacetate film, a polyethylene terephthalate film, etc., or a glass plate.

The silver halide photographic materials of this invention include color photographic positive films, color photographic papers, color photographic negative films, color reversal films (which may or may not containing or not-containing couplers), process photographic light-sensitive materials (e.g., lith films, lith films, etc.), light-sensitive materials for cathode ray tube display (e.g., mammographic light-sensitive materials, direct radiographic light-sensitive materials using an intensifying screen and indirect radiographic light-sensitive materials), light-sensitive materials for silver salt diffusion transfer process, light-sensitive materials for color diffusion transfer process, light-sensitive materials for imhibition transfer process, light-sensitive materials for a silver dye bleaching process, light-sensitive materials for recording print out images, direct print image type light-sensitive materials, heatdevelopable light-sensitive materials, light-sensitive materials for physical development, etc.

For the light-exposure for obtaining photographic images in this invention, an ordinary exposure means may be used. That is, conventional light sources such as natural light (sun light), a tungsten lamp, a fluorescent lamp, a mercury lamp, a xenon arc lamp, a carbon arc lamp, a xenon flash lamp, a cathode ray tube flying spot, etc., can be used.

The exposure time is generally from 1/1000 sec to 30 seconds but the exposure time may be shorter than 1/1000 sec., such as from $1/10^4$ to $1/10^6$ using a xenon flash lamp or a cathode ray tube, or may be longer than 30 seconds. If necessary, the spectral composition of light can be controlled by using color filters. Furthermore, laser light can be used for the light exposure. Also, light emitted from a fluorescent substance excited by electron rays, X-rays, $\gamma$-rays, $\alpha$-rays, etc., may used for the light exposure.

For processing the photographic light-sensitive material of this invention, the known processes and known processing solutions as described, e.g., in *Research Disclosure*, No. 17643 (RD-17643), pages 28–30 can be applied.

The photographic process may be a process for forming silver images (a black and white photographic process) or a process of forming dye images (a color photographic process) according to the purpose. The processing temperature is usually from 18° C. to 50° C. but, as the case may be, may be lower than 18° C. or higher than 50° C.

It is preferred that the dye of formula (I) useful in this invention is added to a coating composition containing the aforesaid mordant at the time of forming the hydrophilic colloid layer containing the mordant, but the dye may also be added to a coating composition for other hydrophilic colloid layer such as silver halide emulsion layer or other light-insensitive layer. In the latter case, it is preferred that the dye is introduced in a layer near the layer containing the mordant or desirably in a layer adjacent to the mordant-containing layer. When the dye is incorporated in a layer containing no mordant, the dye diffuses in the layer containing the mordant and concentrateds there, whereby the layer containing the mordant is selectively dyed in the finished photographic light-sensitive material. The dye may be present in two or more layers.

The hydrophilic colloid layer containing mordant may be composed of a single layer or two or more layers and the layer may be disposed on a photographic emulsion layer (farther side from the support), between photographic emulsion layers when plural emulsion layers are present, or between the support and the photographic emulsion layer. The function of the layer selectively dyed by the presence of the mordant may be as a filter layer, an antihalation layer or a layer for other purposes according to the position of the layer within the material.

When the photographic light-sensitive material is a color photographic material, there is no particular restriction on the color processing. For example, a system of performing, after imagewise exposure, color development, bleach-fixing (blixing), and, if necessary, washing, and stabilizing; a system of perforating, after imagewise exposure, color developing, bleaching fixing, and, if necessary, washing, and stabilizing; system of performing, after imagewise exposure, developing by a developer containing a black and white developing agent, after applying thereto uniform exposure, color developing, blixing, and, if necessary, washing and stabilizing; and a system of performing, after imagewise exposure, developing using a developer containing a black and white developing agent, further developing with a color developer containing a fogging agent (e.g., sodium boron hydride), blixing, and, if necessary, washing and stabilizing, may be employed.

The invention is further described in more detail based on the following examples. Unless otherwise indicated, all parts, percents, ratios and the like are by weight.

EXAMPLE 1

To 30 ml of an aqueous 10% gelatin solution were added 5 ml of an aqueous solution containing the dye of formula (I) used in this invention or a comparison dye shown in Table 1 below in an amount of $2\times10-4$ mole, a hardening agent, an a surface active agent, and then distilled water was further added thereto to make the whole volume 50 ml. The dye solution was coated on a cellulose triacetate film and dried to provide each sample.

Each sample obtained was dipped in distilled water of 50° C. for 30 seconds and dried. The visible spectra of each sample before and after dipping were measured and the fixing ratio of the dye was determined from the optical densities at the absorption maximum wavelength as follows;

$$\text{Fixing ratio}(\%) = \frac{D_1}{D_2} \times 100$$

(wherein $D_1$ is the optical density of the sample before dipping in distilled water and $D_2$ is the optical density after dipping.)

Also, each of the samples was dipped in a developer having the composition shown below for one minute at 30° C., then washed with water for 10 seconds and dried. The visible spectra of each sample before and after dipping in the developer were measured and the decoloring ratio was determined from the optical densities of the sample at the absorption maximum wavelength as follows.

$$\text{Decoloring ratio}(\%) = \frac{D_1 - D_3}{D_1} \times 100$$

(wherein $D_1$ is the optical density of the sample before dipping in the developer and $D_3$ is the optical density after dipping.)

The results obtained are shown in Table 1 below.

| Composition of Developer | |
|---|---|
| Metol | 1 g |
| Anhydrous Sodium Sulfite | 15 g |
| Hydroquinone | 4 g |
| Sodium Carbonate mono-hydrate | 27 g |
| Potassium Bromide | 0.7 g |
| Water to make | 1 liter |

TABLE 1

| Sample No. | Dye | Fixing Ratio | Decoloring Ratio |
|---|---|---|---|
| 1 | A (Comparison) | 18 | 93 |
| 2 | B (Comparison) | 50 | 88 |
| 3 | C (Comparison) | 92 | 72 |
| 4 | D (Comparison) | 15 | 98 |
| 5 | E (Comparison) | 20 | 94 |
| 6 | F (Comparison) | 93 | 75 |
| 7 | 8 (Invention) | 90 | 93 |
| 8 | 10 (Invention) | 92 | 90 |
| 9 | 12 (Invention) | 88 | 89 |
| 10 | 15 (Invention) | 91 | 92 |

TABLE 1-continued
| Sample No. | Dye | Fixing Ratio | Decoloring Ratio |
|---|---|---|---|
| 11 | 29 (Invention) | 91 | 90 |
| 12 | 31 (Invention) | 97 | 87 |
Comparison dyes A, B, and C used above are those described in JP-A-58-143342, Comparison dye D is the dye described in JP-A-59-111641, and Comparison Dyes E and F are those described in JP-A-50-147712 as shown below.
A
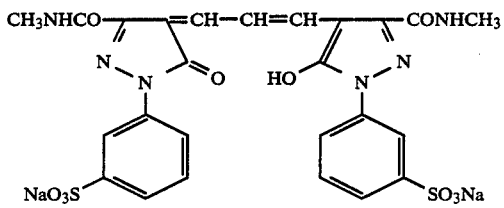
B
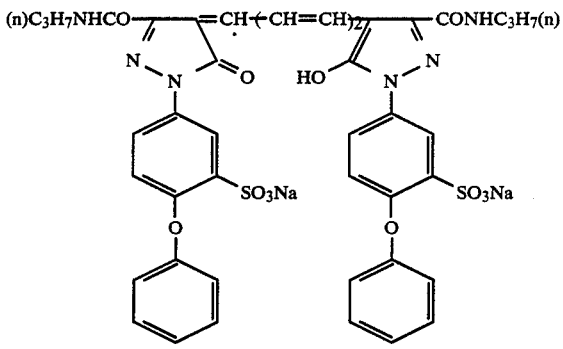
C
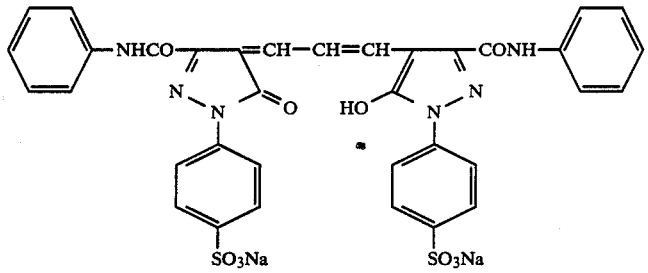
D
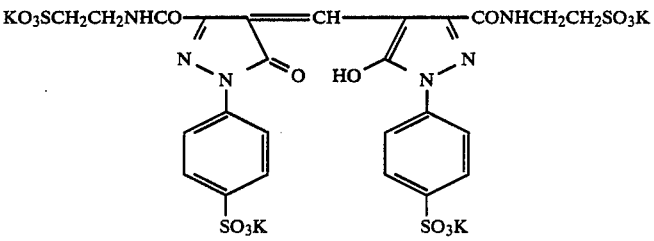
E
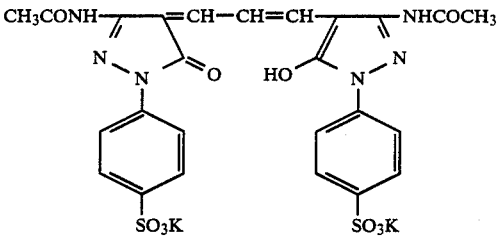

-continued

F

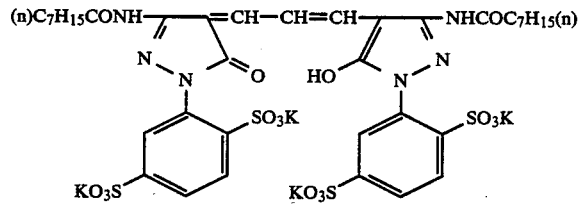

The results obtained as shown in Table 1, demonstrate that Samples 1 to 6 using the comparison dyes do not readily obtain both good fixing ratio of the dye and decoloring ratio thereof, while Samples 7 to 12 of this invention show a high fixing ratio of dyes and a high decoloring ratio thereof, which indicates that dyes used in this invention are excellent as photographic dyes.

EXAMPLE 2

A coating solution having the composition (a) containing the dye described in Table 2 shown below was coated on a cellulose acetate support having a subbing layer as an antihalation layer at a thickness of 1 μm.

On the antihalation layer was coated a silver iodobromide emulsion color sensitized to red light and containing a cyan coloring coupler at a thickness of 5 μm. Then, a gelatin interlayer of 1.5 μm was formed thereon and further a silver iodobromide emulsion color sensitized to green light and containing a magenta coloring coupler was coated on the interlayer at a thickness of 4 μm. Then, a yellow filter layer having composition (b) shown below was coated thereon at a thickness of 2 μm, a blue-sensitive silver iodobomide emulsion containing a yellow coloring coupler was coated on the yellow filter layer at a thickness of 5 μm, and finally a surface protective layer composed of gelatin was coated on the top emulsion layer at a thickness of 1 μm. Thus, Samples 13 to 19 were prepared in this manner.

Also, for comparison, a sample having the same layer structure as above but containing no dye in the antihalation layer was prepared to provide Sample 20.

The samples thus obtained are negative color photographic light-sensitive materials.

| | |
|---|---|
| Coating Composition (a) for Antihalation Layer: | |
| Aqueous 10% Gelatin Solution | 500 ml |
| Dye (shown in Table 2) 10% | 32 ml |
| 2,4-Dichloro-6-hydroxy-1,3,5-triazine Sodium Salt 1% | 25 ml |
| Dodecaethylene Glycol-4-nonylphenol Ether 2% | 30 ml |
| Coating Composition (b) for Yellow Filter Layer: | |
| Aqueous 6% Gelatin solution (containing Carey-Lea type yellow colloid silver) | 500 ml |
| 2,4-Dichloro-6-hydroxy-1,3,5-triazine Sodium Salt 1% | 25 ml |
| Polyethylene Glycol-4-nonylphenol Ether 2% | 30 ml |

Each sample was exposed to a tungsten light source of 5500° K. in color temperature for 1/200 second through a Fuji color separation filter Sp-3 (maximum transmittance (Tmax)=about 92%, wave length of Tmax/2 is about 600 μm) and a continuous grey wedge and then processed as follows.

| Step | Temperature | Time |
|---|---|---|
| 1. Color Development | 37.8° C. | 3½ min. |
| 2. Wash | " | 1 min. |
| 3. Bleach | " | 6 min. |
| 4. Wash | " | 1 min. |
| 5. Fix | " | 6 min. |
| 6. Wash | " | 1 min. |
| 7. Stabilization | " | 1 min. |

The compositions of the processing solutions used for the aforesaid steps were as follows.

| | |
|---|---|
| Color Developer | |
| Sodium Hydroxide | 2 g |
| Sodium Sulfite | 2 g |
| Potassium Bromide | 0.4 g |
| Sodium Chloride | 1 g |
| Borax | 4 g |
| Hydroxylamine Sulfate | 2 g |
| Ethylenediaminetetraacetic Acid Tetra-Sodium Salt | 2 g |
| 4-Amino-3-methyl-N-ethyl-N-(β-hydroxyethyl)aniline.sesquisulfate (mono-hydrate) | 4 g |
| Water to make | 1 liter |
| Bleach Solution | |
| Ethylenediaminetetraacetic Acid.-Ferric Complex Salt.Sodium Salt | 100 g |
| Potassium Bromide | 50 g |
| Ammonium Nitrate | 50 g |
| Boric Acid | 5 g |
| Water to make | 1 liter |
| Fix Solution | |
| Sodium Thiosulfate | 150 g |
| Sodium Sulfite | 15 g |
| Borax | 12 g |
| Glacial Acetic Acid | 15 ml |
| Potassium Alum | 20 g |
| Water to make | 1 liter |
| Stabilization Solution | |
| Boric Acid | 5 g |
| Sodium Citrate | 5 g |
| Sodium Metaborate.tetra-hydrate | 3 g |
| Potassium Alum | 15 g |
| Water to make | 1 liter |

Based on the cyan images formed on each sample thus processed, a photographic characteristic curve was made, a light exposure amount required to obtain a density of fog+0.1 was obtained, and the reciprocal thereof was used as the sensitivity value. The relative values of the sensitivity and the amount of fog obtained on each sample are shown in Table 2.

TABLE 2

| Sample | Dye | Specific Sensitivity of Red Exposed Cyan Image | Stain |
|---|---|---|---|
| 13 | (G) | 53 | none |
| 14 | (H) | 65 | none |
| 15 | (I) | 88 | observed |
| 16 | (I-18) | 82 | none |

TABLE 2-continued

| Sample | Dye | Specific Sensitivity of Red Exposed Cyan Image | Stain |
|---|---|---|---|
| 17 | (I-24) | 88 | none |
| 18 | (I-39) | 85 | none |
| 19 | (I-43) | 81 | none |
| 20 | None (Contrast) | 100 | none |

(G) to (I): Comparison Dyes. (I-18), (I-24), (I-39), and (I-43): Dyes of this invention.

The structures of the comparison dyes G, H, and I used above are as follows.

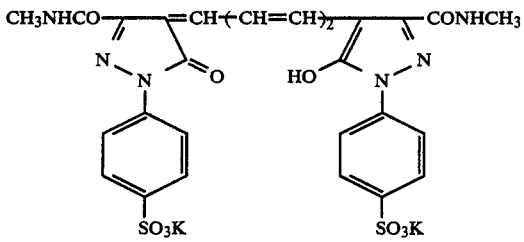

G ($\pi CH_3 = 0.56$)

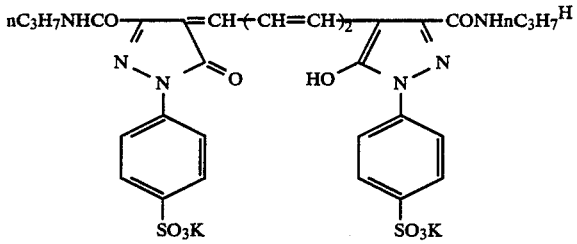

H ($\pi nC_3H_7 = 1.55$)

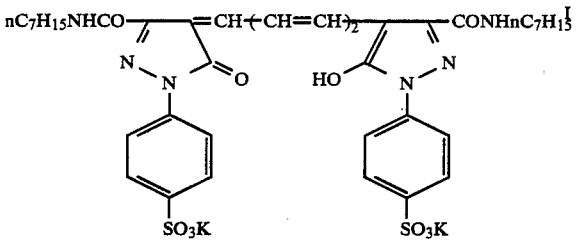

I ($\pi nC_7H_{15} = 3.905$)

From the above results, it can be seen that in Comparison Samples 13, 14, and 15, the sensitivity of the red-sensitive emulsions is considerably reduced in comparison to that of the contrast sample due to the filter effect by the diffusion of the dye from the antihalation layer into the red-sensitive emulsion layer (Samples 13 and 14) or the formation of fog based on the remaining color of the dye is large (Sample 15), while in Samples 16, 17, 18, and 19 using the dyes of this invention, the desensitization is relatively low and no fog is formed.

EXAMPLE 3

To 95 ml of an aqueous 10% gelatin solution were added 25 ml of an aqueous solution containing $2.3\times10-4$ mole of the dye of this invention shown in Table 3 below or a comparison dye shown in Table 3, 0.6 g of a mordant shown below, and a hardening agent, and further distilled water was added thereto to make the whole volume 150 ml.

Mordant: (II-16)

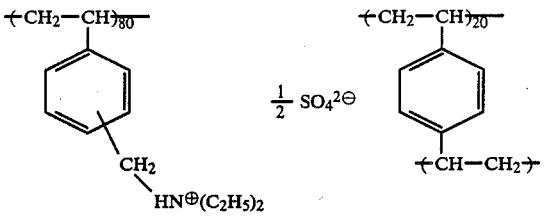

The dye solution was coated on a cellulose triacetate film followed by drying. Thus, Samples 21 to 32 were prepared.

Each sample was dipped in a buffer having pH of 7.0 for 10 minutes at 25° C. and dried.

The fixing ratio of the dye was determined in the manner same as in Example 1 and the results obtained are shown in Table 3 below.

Also, each sample was dipped in a developer having the composition shown below for 25 seconds at 25 seconds at 35° C., washed with water for 20 seconds, and dried.

The decoloring ratio was measured in the same manner in Example 1.

| Composition of Developer | |
|---|---|
| 1-Phenyl-3-pyrazolidone | 1.5 g |
| Hydroquinone | 30 g |
| 5-Nitroindazole | 0.25 g |
| Potassium Bromide | 3.0 g |
| Anhydrous Sodium Sulfite | 50 g |
| Potassium Hydroxide | 30 g |
| Boric Acid | 10 g |
| Glutaraldehyde | 5 g |
| Water to make | 1 liter |
| pH | adjusted to 10.20 |

The structures of Comparison dyes J, K, L, and M are as follows.

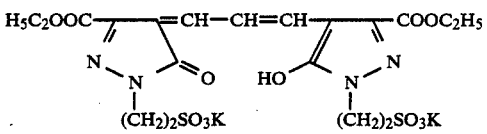

J

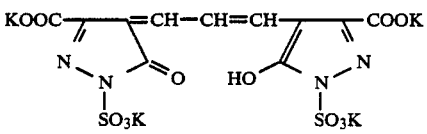

K

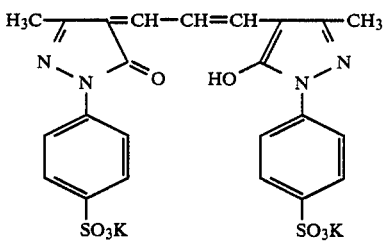

L

-continued

M

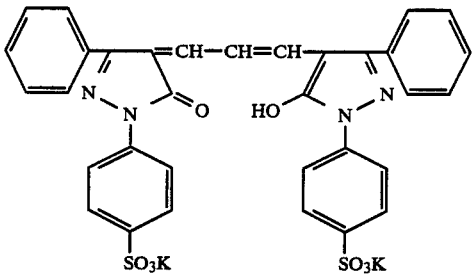

TABLE 3

| Sample No. | | Dye | Fixing Ratio (%) | Decoloring Ratio (%) |
|---|---|---|---|---|
| | 21 | J | 30 | 9 |
| | 22 | K | 75 | 65 |
| | 23 | L | 85 | 55 |
| Comparison | 24 | M | 98 | 20 |
| | 25 | Comparison Dye G in Example 2 | 83 | 97 |
| | 26 | Comparison Dye H in Example 2 | 98 | 80 |
| | 27 | 1 | 92 | 90 |
| | 28 | 11 | 92 | 92 |
| Invention | 29 | 8 | 97 | 95 |
| | 30 | 25 | 97 | 95 |
| | 31 | 29 | 97 | 96 |
| | 32 | 43 | 95 | 97 |

As is clear from the results shown in Table 3, in systems using the mordant, Samples 27 to 32 using the dyes in this invention are superior in fixing ratio and decoloring ratio of dye to Comparsion Samples 21 to 26.

EXAMPLE 4

Each film base was prepared by coating on both surfaces of a polyethylene terephthalate film base 175 μm thick a subbing layer of the coating composition shown below containing the dye shown in Table 4 below.

| | |
|---|---|
| Gelatin | 84 mg/m$^2$ |
| Mordant (II - 16) | 60 mg/m$^2$ |

Each surface of the base was coated with the coating composition of Emulsion A shown below and the surface protective layer shown below at a silver coverage per side of 1.95 g/m$^2$.

PREPARATION OF EMULSION A

To 1 liter of water were added 5 g of potassium bromide, 0.05 g of potassium iodide, 30 g of gelatin, and 2.5 ml of an aqueous solution of 5% thioether, $HO(CH_2)_2S(CH_2)_2S(CH_2)_2OH$ and while keeping the mixture at 75° C., an aqueous solution of 8.33 g of silver nitrate and an aqueous solution of 5.94 g of potassium bromide and 0.726 g of potassium iodide were added to the mixture by a double jet method over a period of 45 seconds. Then, after adding thereto 2.5 g of potassium bromide, an aqueous solution of 8.33 g of silver nitrate was added to the mixture over a period of 7 min. and 30 sec. so that the flow rate at the end of the addition became twice that at the initiation of the addition. Then, an aqueous solution of 153.34 g of silver nitrate and an aqueous solution of potassium bromide were added thereto by a controlled double jet method while keeping pAg at 8.1 over a period of 25 minutes. In this case, the flow ratio was accelerated so that the flow ratio immediately before the end of the addition became 8 times the flow rate at the initiation of the addition. Thereafter, 15 ml of an aqueous solution of 2N potassium thiocyanate was added and further 50 ml of an aqueous 1% potassium iodide solution was added thereto over a period of 30 seconds. Then, after reducing the temperature of the emulsion formed and removing soluble salts therefrom by a flocculation method, the temperature was raised to 40° C. Then, 68 g of gelatin, 2 g of phenol, and 7.5 g of trimethylolpropane were added thereto and the pH and pAg thereof were adjusted to 6.40 and 8.10, respectively with sodium hydroxide and potassium bromide.

Thus, the temperature thereof was raised to 56° C. and 744 mg/1 mole-Ag of a sensitizing dye having the structure shown below was added to the emulsion. Then, after 10 minutes 8.2 mg of sodium thiosulfate pentahydrate, 163 mg of potassium thiocyanate, and 5.4 mg of chloroauric acid were added to each emulsion and after 5 minutes, the emulsion was quickly cooled to provide Emulsion A.

In the silver halide emulsion obtained, 93% of the total projected areas of the whole silver halide grains were composed of the grains having an aspect ratio of at least 3, the mean projected area diameter of the whole grains having an aspect ratio of at least 2 was 0.83 μm, the standard deviation was 18.5%, the mean thickness was 0.161 μm, and the mean aspect ratio of 5.16.

Sensitizing Dye:

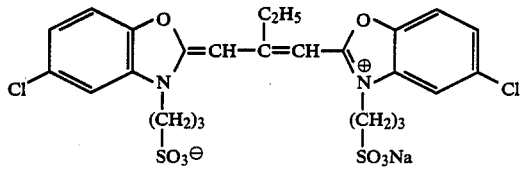

PREPARATION OF EMULSION COATING COMPOSITION

The coating composition was prepared by adding the following materials to Emulsion A formed above in the amounts shown below per mole of the silver halide.

| | |
|---|---|
| 4-Hydrxy-6-methyl-1,3,3a,7-tetraazaindene | 1.94 g |
| Polymer Latex (Poly(ethyl acrylate/-methacrylic acid) = 97/3) | 25.0 g |
| Hardening Agent, 1,2-bix(sulfonyl-acetamido)ethane | 2.3 g |
| 2,6-Bis(hydroxyamino)-4-diethylamino-1,3,5-triazine | 80 mg |
| Sodium Polyacrylate (mean molecular weight 41,000) | 4.0 g |
| Potassium Polystyrenesulfonate (mean molecular weight 600,000) | 1.0 g |

Surface Protective Layer

| Composition | Coating Amount |
|---|---|
| Gelatin | 0.8 g/m$^2$ |
| Dextran (mean molecular weight 40,000) | 0.8 g/m$^2$ |
| Sodium Polyacrylate (mean molecular weight 400,000) | 0.02 g/m$^2$ |
| Sodium p-t-Octylphenoxydiglyceryl-butyl Sulfonate | 0.02 g/m$^2$ |
| Polyoxyethylene Cetyl Ether | 0.035 g/m$^2$ |

-continued

| | |
|---|---|
| (polymerization degree 10) | |
| Polyoxyethylene (polymerization degree 10)-polyoxyglyceryl-p-octylphenoxy Ether (polymerization degree 3) | 0.01 g/m$^2$ |
| $C_8F_{17}SO_3K$ | 0.003 g/m$^2$ |
| Polymethyl methacrylate particles | |
| $C_8F_{17}SO_2N(C_3H_7)(CH_2)_4(CH_2)_4SO_3Na$ | 0.001 g/m$^2$ |
| $C_8F_{17}SO_2N(C_3H_7)(CH_2CH_2O)_{10}(CH_2CH_2CH_2O)_4H$ | 0.003 g/m$^2$ |
| (mean particle size 3.5 μm) | 0.025 g/m$^2$ |
| Poly(methyl methacrylate/methacrylate) particles (mole ratio 7/3, mean particle size 2.5 μm) | 0.020 g/m$^2$ |

Thus, photographic materials 1 to 8 were obtained.

For the X-ray exposure of photographic materials 1–8 thus obtained, Grenex series G-4 Screen (intensifying screen, trade name, made by Fuji Photo Film Co.), ($Gd_2O_2S$:Tb) was used, each of the photographic materials 1 to 8 was closely sandwiched between two sheets of the G-4 screens and exposed to X-rays through 10 cm of water Phantome according in a conventional manner. After processing, the sharpness of the images was measured by an aperture of 30 μm=500 μm and evaluated using an MTF value of which the space frequency was 2.0 cycles/mm. MTF was evaluated at the portion having an optical density of 1.0 in both surfaces.

In addition, MTF is described in T. H. James, *The Theory of the Photographic Process*, 4th edition, pages 592–618.

Also, the processing was performed by using Automatic Processor, FPM-4000, (trade name, made by Fuji Photo Film Co.), Developer RD-III (made by the same company), and a fixing solution, Fuji F (made by the same company).

EVALUATION OF RESIDUAL COLOR

By processing the unexposed sample films by the aforesaid automatic processor using the aforesaid processing solutions, the level of the residual color was functionally evaluated. The evaluation were made as follows.

A—State of scarcely perceiving residual color.

C—State of perceiving residual color but gives no serious influences in practical use.

E—State of clearly perceiving residual color, which causes serious problem on practical use.

In addition, ranks B and D are between the aforesaid states A and C, and C and E, respectively.

The results obtained are shown in Table 4 below.

TABLE 4

| | Sample No. | Dye and (Coated amount) | Relative Sensitivity | MTF in the Combination with G-4 Screen | Evaluation of Residual Value |
|---|---|---|---|---|---|
| | 1 | Compound (a) in Example 3 (15 mg/m$^2$) | 88 | 0.52 | B |
| | 2 | Compound (a) in Example 3 (22 mg/m$^2$) | 80 | 0.54 | D |
| Comparison | 3 | compound (b) in Example 3 (17.5 mg/m$^2$) | 87 | 0.54 | C |
| | 4 | Compound (b) in Example 3 (22 mg/m$^2$) | 84 | 0.55 | D |
| | 5 | Compound (c) in Example 3 (14.2 mg/m$^2$) | 91 | 0.55 | D |
| | 6 | I-9 (17.8 mg/m$^2$) | 91 | 0.55 | B |
| Invention | 7 | I-8 (18.4 mg/m$^2$) | 91 | 0.55 | B |
| | 8 | I-15 (18.3 mg/m$^2$) | 91 | 0.55 | B |
| (Reference) | | No Dye | 100 | 0.49 | A |

(Reference): Same as other sample except that the dye in the subbing layers was omitted.

As is clear from the results shown in Table 4, in the case of the comparison photographic materials 1–5, the relative sensitivity is greatly reduced by the filter effect based on the diffusion of the dye from the subbing layer into the emulsion layer, or the formation of residual color is serious even if the relative sensitivity is not reduced, while in the photographic materials 6 and 7 using the dyes of this invention, the occurrence of desensitization is reduced and the occurrence of residual color is less.

Also, it can be seen that by forming the subbing layers using the dye used this invention, the sharpness (MTF) is also improved.

EXAMPLE 5

By following the same procedure as Example 4 except that the addition amount of the hardening agent for the emulsion coating composition was changed to 20 mmol/100 g gel, a coating composition for emulsion was prepared.

Then, by following the same procedure using the emulsion as in Example 4, Photographic materials 8 to 12 were prepared. Each of the samples was exposed and the residual color of them was evaluated as in Example 4.

In this case, however, processing as described in the following photographic evaluation was employed.

EVALUATION OF PHOTOGRAPHIC PERFORMANCE

Each sample was exposed as in Example 4 and processed by an automatic processer using the following developer and fixing solutions.

| Concentrated Developer | |
|---|---|
| Potassium Hydroxide | 56.6 g |
| Sodium Sulfite | 200 g |
| Diethylenetriaminepentaacetic Acid | 6.7 g |
| Potassium Carbonate | 16.7 g |
| Boric Acid | 10 g |
| Hydroquinone | 83.3 g |
| Diethylene Glycol | 40 g |
| 4-Hydroxymethyl-4-methyl-1-phenyl-3-pyrazolidone | 11.0 g |
| 5-Methylbenzotriazole | 2 g |
| Water to make | 1 liter |
| pH | adjusted to 10.60 |

-continued

| Concentrated Fixing Solution | |
|---|---|
| Ammonium Thiosulfate | 560 g |
| Sodium Sulfite | 60 g |
| Ethylenediaminetetraacetic Acid.Di-Sodium.Dihydrate | 0.10 g |
| Sodium Hydroxide | 24 g |
| Water to make | 1 liter |
| pH adjusted by acetic acid to | 5.10 |

| Automatic Processor | Volume | Quick Process |
|---|---|---|
| Developer Tank | 6.5 liters | 35° C. × 12.5 sec. |
| Fix Tank | 6.5 liters | 35° C. × 10 sec. |
| Wash Tank | 6.5 liters | 20° C. × 7.5 sec. |
| Drying | | 50° C. |
| Dry to Dry Processing time | | 48 sec. |

For initiation of the processing, each tank was filled with each of the following processing solutions.

Developer Tank: In the tank were placed 333 ml of the aforesaid concentrated developer, 667 ml of water, and 10 ml of a starter containing 2 g of potassium bromide and 1.8 g of acetic acid, and the pH of the mixture was adjusted to 10.15.

Fix Tank: In the tank were placed 250 ml of the aforesaid fix solution and 750 ml of water.

The results obtained are summarized in Table 5 below.

TABLE 5

| Sample No. | | Dye and (Coated amount) | Relative Sensitivity | Evaluation of Residual Value |
|---|---|---|---|---|
| Comparison | 8 | Compound B in Example 3 (17.5 mg/m$^2$) | 87 | D |
| | 9 | Compound C in Example 3 (14.2 mg/m$^2$) | 91 | E |
| Invention | 10 | Dye I-9 (17.8 mg/m$^2$) | 91 | B |
| | 11 | Dye I-8 (18.4 mg/m$^2$) | 90 | B |
| | 12 | Dye I-15 (18.4 mg/m$^2$) | 90 | B |

As is clear from the results shown in Table 5, the samples of this invention are also excellent in relative sensitivity and residual color when processed in such a quick processing system.

EXAMPLE 6

A base was prepared by coating both surfaces of a blue-colored polyethylene terephthalate film 175 μm thick with a subbing layer having the composition shown below and containing the dye of invention or the comparison dye shown in Table 6 below at the coating amount shown in the same table.

| | |
|---|---|
| Gelatin | 84 mg/m$^2$ |
| Mordant shown in Table 6 | 50 mg/m$^2$ |

Both surfaces of the base were coated with the coating composition of the emulsion described below together with the surface protective layer at a silver coverage of 1.95 g/m$^2$ per layer.

PREPARATION OF EMULSION

To one liter of water in a vessel were added 30 g of gelatin and 6 g of potassium bromide, and then an aqueous silver nitrate solution (5 g of silver nitrate) and an aqueous potassium bromide solution containing 0.15 g of potassium iodide were added to the mixture by a double jet method over a period of one minute. Furthermore, an aqueous silver nitrate solution (145 g as silver nitrate) and an aqueous potassium bromide solution containing 4.2 g of potassium iodide were added thereto by a double jet method. In this case, the flow rate was controlled so that the flow rate immediately before the end of the addition became 5 times that at the initiation of the addition of them.

After finishing the addition, soluble salts were removed by a flocculation method at 35° C., and after raising the temperature to 40° C. and further adding thereto 75 g of gelatin, the pH thereof was adjusted to 6.7.

The emulsion obtained was composed of tabular silver halide grains having a mean projected area diameter of 0.98 μm and a mean thickness of 0.138 μm. The content of silver iodide was 3 mole %.

The emulsion was chemically sensitized by applying thereto gold and sulfur sensitization to provide a silver halide photographic emulsion.

To the emulsion obtained were added 500 mg/mole-Ag of the following sensitizing dye and 200 mg/mole-Ag of potassium iodide.

Furthermore, 4-hydroxy-6-methyl-1,3,3*a*,7-tetraazaindene and 2,6-bis(hydroxylamino)-4-diethylamino-1,3,5-triazine as stabilizers, trimethylolpropane as a dry fogging preventer, a coating aid, and a hardening agent Sensitizing Dye:

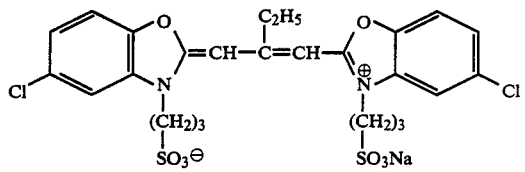

were added to the emulsion to provide a coating composition of the emulsion.

SURFACE PROTECTIVE LAYER

An aqueous dispersion containing gelatin as well as sodium polystyrenesulfonate, polymethyl methacrylate particles (mean particle size 3.0 μm), polyethylene oxide, and a hardening agent was used for the surface protective layer.

Thus, Samples 1 to 7 of photographic light-sensitive materials were obtained.

Then, the MTF value of each sample was evaluated in the same manner as in Example 4.

The results obtained are shown in Table 6 below, wherein the relative sensitivity is shown as a relative value of each sample with Sample 1 being defined as 100.

TABLE 6

| Sample No. | Mordant | Dye and (Coated amount) | Relative Sensitivity | MTF in the Combination with G-4 Screen | Evaluation of Residual Color |
|---|---|---|---|---|---|
| Comparison 1 | — | | 100 | 0.48 | A |

TABLE 6-continued

| Sample No. | Mordant | Dye and (Coated amount) | Relative Sensitivity | MTF in the Combination with G-4 Screen | Evaluation of Residual Color |
|---|---|---|---|---|---|
| Comparison 2 | III-1 | Compound (b) in Example 7 (17.5 mg/m$^2$) | 85 | 0.54 | C |
| Comparison 3 | III-15 | compound (a) in Example 7 (15 mg/m$^2$) | 87 | 0.51 | B |
| Comparison 4 | III-24 | Compound (c) in Example 7 (14.2 mg/m$^2$) | 91 | 0.54 | D |
| This Invention 5 | III-1 | I-8 (18.4 mg/m$^2$) | 89 | 0.54 | B |
| This Invention 6 | III-15 | I-8 (18.4 mg/m$^2$) | 88 | 0.54 | B |
| This Invention 7 | III-24 | I-8 (18.4 mg/m$^2$) | 91 | 0.54 | B |

As is clear from the results shown in Table 6 above, in the case of the comparison examples (Samples 1–4), the relative sensitivity is greatly reduced by the filter effect based on the diffusion of the dye from the subbing layer into the emulsion layer or the formation of residual color is large even when the relative sensitivity is not reduced, while in the samples of this invention (Samples 5 to 7), the occurrence of desensitization is less and further the formation of residual color is less as compared to the comparison samples having a similar MTF value.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one hydrophilic colloid layer containing at least one dye represented by formula (I),

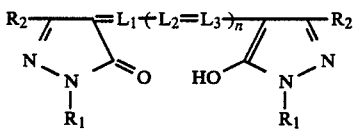

(I)

wherein $R_1$ represents a substituted or unsubstituted aryl group, a substituted or unsubstituted alkyl group, a substituted or unsubstituted aralkyl group, or a substituted or unsubstituted heterocyclic group, each group being substituted by at least one carboxylic acid group or sulfonic acid group; $R_2$ represents —$CONR_3R_4$ or —$NR_3COR_4$, wherein $R_3$ represents a hydrogen atom or an alkyl group and $R_4$ represents a substituted or unsubstituted alkyl group having a hydrophobic substituent constant $\pi$ of about $1.60 \leqq \pi \leqq$ about 3.90; $L_1$, $L_2$, and $L_3$ each represents a substituted or unsubstituted methine group; and n represents 0, 1, or 2.

2. A silver halide photographic material according to claim 1, and further containing a mordant in at least one hydrophilic colloid layer, said mordant being represented by formula (II),

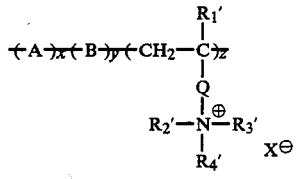

(II)

wherein A represents a monomer unit comprising a copolymerizable monomer having at least two copolymerizable ethylenically unsaturated groups, at least one of said groups being contained in the side chain of the monomer; B represents a monomer unit comprising a copolymerizable ethylenically unsaturated monomer; $R_1'$ represents a hydrogen atom, a lower alkyl group, or an aralkyl group; $R_2'$, $R_3'$, and $R_4'$, which may be the same or different, each represents a hydrogen atom, an alkyl group, an aryl group, or an aralkyl group, each of which may be substituted; Q represents a single bond, an alkylene group, a phenylene group, an aralkylene group,

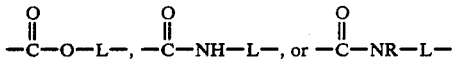

wherein L represents a substituted or unsubstituted alkylene group, a substituted or unsubstituted arylene group, or a substituted or unsubstituted aralkylene group and R represents a substituted or unsubstituted alkyl group; two or more of Q, $R_2'$, $R_3'$, and $R_4'$ may combine with each other to form a single ring or composite ring structure containing at least one nitrogen atom; $X^{\ominus}$ represents an anion; x represents from 0 to 60 mole %; y represents from 0 to 60 mole %; and z represents from 30 to 100 mole %.

3. A silver halide photographic material according to claim 1, and further containing a mordant in at least one hydrophilic colloid layer, said mordant being represented by formula

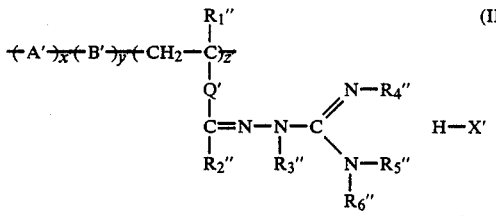

(III)

wherein A′ represents a monomer unit comprising a copolymerizable monomer having at least two copolymerizable ethylenically unsaturated groups, at least one of said groups being contained in a side chain of the monomer; B′ represents a monomer unit comprising a copolymerizable ethylenically unsaturated monomer; $R_1''$ represents a hydrogen atom, a lower alkyl group, or an aralkyl group; $R_2''$, $R_3''$, $R_4''$, $R_5''$, and $R_6''$, which may be the same or different, each represents a hydrogen atom, an alkyl group, an aryl group, or an aralkyl group, each of which may be substituted; Q′ represents a single bond, an alkylene group, a phenylene group, an aralkylene group, $$-\overset{O}{\overset{\|}{C}}-O-L'-,\ -\overset{O}{\overset{\|}{C}}-NH-L'-,\ \text{or}\ -\overset{O}{\overset{\|}{C}}-NR'-L'-$$

wherein L′ represents a substituted or unsubstituted alkylene group, a substituted or unsubstituted arylene group, or a substituted or unsubstituted aralkylene group and R′ represents a substituted or unsubstituted alkyl group; two or more of Q′, $R_2''$, $R_3''$, $R_4''$, $R_5''$, and $R_6''$ may combine with each other to form a ring structure containing at least one nitrogen atom; H—X′ represents a proton acid material; x′ represents from 0 to 60 mole %, y′ represents from 0 to 60 mole %, and z′ represents from 30 to 100 mole %.

4. The silver halide photographic material as claimed in claim 2, wherein in the mordant of formula (II), at least one of $R_2'$, $R_3'$, and $R_4'$ represents a hydrogen atom and x is from 5 to 60 mol %.

5. The silver halide photographic material as claimed in claim 1, wherein $R_1$ represents an alkyl group of from 1 to 6 carbon atoms, an aralkyl group having from 7 to 15 carbon atoms, a phenyl or naphthyl group or a 5- or 6-membered nitrogen-containing heterocyclic group, each group being substituted by at least one carboxylic acid group or sulfonic acid group; $R_3$ represents a hydrogen atom; $R_4$ represents an alkyl group substituted by a hydroxy group, a carboxylic acid group, a sulfonic acid group, a chlorine atom, a bromine atom, a cyano group, an alkoxy group, an amino group, a amido group, a carbamoyl group, or a sulfamoyl group.

6. The silver halide photographic material as claimed in claim 1, wherein $R_3$ represents a hydrogen atom and $R_4$ represents an unsubstituted alkyl group having from 4 to 6 carbon atoms, a 4-chlorobutyl group, a 7-hydroxyheptyl group, a 6-carboxyhexyl group, an 8-hydroxyoctyl group, a 5-cyanopentyl group, a cyclopentyl group, or a cyclohexyl group.

7. The silver halide photographic material as claimed in claim 1, wherein said carboxylic acid group or sulfonic acid group substituted on the group represented by $R_1$ is in the form of the free acid or a salt thereof.

8. The silver halide photographic material according to claim 1, wherein $R_1$ is a phenyl group having at least one sulfonic acid group, an alkyl group of from 1 to 4 carbon atoms having at least one sulfonic acid group, a benzyl group having at least one sulfonic group, or a phenethyl group having at least one sulfonic acid group.

9. The silver halide photographic material according to claim 1, wherein the dye is incorporated in a silver halide emulsion layer, a filter layer, and antihalation layer or an interlayer.

10. The silver halide photographic material according to claim 2, wherein said dye is present in a layer adjacent to the mordant-containing layer.

11. The silver halide photographic material according to claim 3, wherein said dye is present in a layer adjacent to the mordant-containing layer.

12. The silver halide photographic material according to claim 2, wherein the dye and the mordant are present in the same hydrophilic colloid layer.

13. The silver halide photographic material according to claim 3, wherein the dye and the mordant are present in the same hydrophilic colloid layer.

14. A silver halide photographic material comprising a support having thereon at least one hydrophilic colloid layer containing at least one dye represented by formula (I),

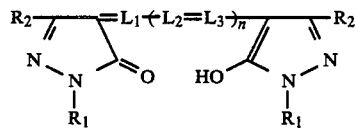

(I)

wherein $R_1$ represents a substituted or unsubstituted aryl group, a substituted or unsubstituted alkyl group, a substituted or unsubstituted aralkyl group, or a substituted or unsubstituted heterocyclic group, each group being substituted by at least one carboxylic acid group or sulfonic acid group; $R_2$ represents $-CONR_3R_4$ or $-NR_3COR_4$, wherein $R_3$ represents a hydrogen atom or an alkyl group and $R_4$ represents a substituted or unsubstituted aralkyl group having a hydrophobic substituent constant $\pi$ of about $1.60 \leqq \pi \leqq$ about 3.90; $L_1$, $L_2$, and $L_3$ each represents a substituted or unsubstituted methine group; and n represents 0, 1, or 2.

15. A silver halide photographic material according to claim 14, and further containing a mordant in at least one hydrophilic colloid layer, said mordant being represented by formula (II),

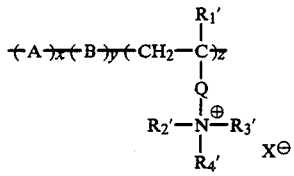

(II)

wherein A represents a monomer unit comprising a copolymerizable monomer having at least two copolymerizable ethylenically unsaturated groups, at least one of said groups being contained in a side chain of the monomer; B represents a monomer unit comprising a copolymerizable ethylenically unsaturated monomer; $R_1'$ represents a hydrogen atom, a lower alkyl group, or an aralkyl group; $R_2'$, $R_3'$, and $R_4'$, which may be the same or different, each represents a hydrogen atom, an alkyl group, an aryl group, or an aralkyl group, each of which may be substituted; Q represents a single bond, an alkylene group, a phenylene group, an aralkylene group, a $$-\overset{O}{\overset{\|}{C}}-O-L-,\ -\overset{O}{\overset{\|}{C}}-NH-L-,\ \text{or}\ -\overset{O}{\overset{\|}{C}}-NR-L-$$

wherein L represents substituted or unsubstituted alkylene group, a substituted or unsubstituted arylene group, or a substituted or unsubstituted aralkylene group and R represents a substituted or unsubstituted alkyl group;

two or more of Q, $R_2'$, $R_3'$, and $R_4'$ may combine with each other to form a single ring or composite ring structure containing at least one nitrogen atom; $X\ominus$ represents an anion; x represents from 0 to 60 moles %; y represents from 0 to 60 mole %; and z represents from 30 to 100 mole %.

16. A silver halide photographic material according to claim 14, and further containing a mordant in at least one hydrophilic colloid layer, said mordant being represented by formula (III)

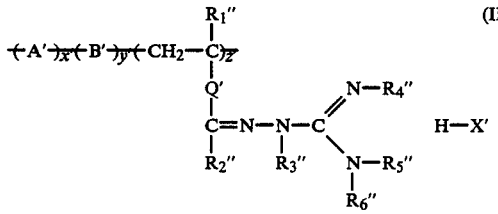

(III)

wherein A' represents a monomer unit comprising a copolymerizable monomer having at least two copolymerizable ethylenically unsaturated groups, at least one of said groups being contained in a side chain of the monomer; B' represents a monomer unit comprising a copolymerizable ethylenically unsaturated monomer; $R_1''$ represents a hydrogen atom, a lower alkyl group, or an aralkyl group; $R_2''$, $R_3''$, $R_4''$, $R_5''$, and $R_6''$, which may be the same or different, each represents a hydrogen atom, an alkyl group, an aryl group, or an aralkyl group, each of which may be substituted; Q' represents a single bond, an alkylene group, a phenylene group, an aralkylene group,

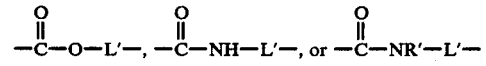

wherein L' represents a substituted or unsubstituted alkylene group, a substituted or unsubstituted arylene group, or a substituted or unsubstituted aralkylene group and R' represents a substituted or unsubstituted alkyl group; two or more of Q', $R_2''$, $R_3''$, $R_4''$, $R_5''$, and $R_6''$ may combine with each other to form a ring structure containing at least one nitrogen atom; H—X' represents a proton acid material; x' represents from 0 to 60 mole %, y' represents from 0 to 60 mole %, and z' represents from 30 to 100 mole %.

17. The silver halide photographic material as claimed in claim 15, wherein in the mordant of formula (II), at least one of $R_2'$, $R_3'$, and $R_4'$ represents a hydrogen atom and x is from 5 to 60 mol %.

18. The silver halide photographic material as claimed in claim 14, wherein $R_1$ represents an alkyl group of from 1 to 6 carbon atoms, an aralkyl group having from 7 to 15 carbon atoms, a phenyl or naphthyl group or a 5- or 6-membered nitrogen-containing heterocyclic group, each group being substituted by at least one carboxylic acid group or sulfonic acid group; $R_3$ represents a hydrogen atom; $R_4$ represents an aralkyl group substituted by a hydroxy group, a carboxylic acid group, a sulfonic acid group, a chlorine atom, a bromine atom, a cyano group, an alkoxy group, an amino group, a amido group, a carbamoyl group, or a sulfamoyl group.

19. The silver halide photographic material as claimed in claim 14, wherein $R_3$ represents a hydrogen atom.

20. The silver halide photographic material as claimed in claim 14, wherein said carboxylic acid group or sulfonic acid group substituted on the group represented by $R_1$ is in the form of the free acid or salt thereof.

21. The silver halide photographic material according to claim 14, wherein $R_1$ is a phenyl group having at least one sulfonic acid group, an alkyl group of from 1 to 4 carbon atoms having at least one sulfonic acid group, a benzyl group having at least one sulfonic group, or a phenethyl group having at least one sulfonic acid group.

22. The silver halide photographic material according to claim 14, wherein the dye is incorporated in a silver halide emulsion layer, a filter layer, and an antihalation layer or an interlayer.

23. The silver halide photographic material according to claim 15, wherein said dye is present in a layer adjacent to the mordant-containing layer.

24. The silver halide photographic material according to claim 16, wherein said dye is present in a layer adjacent to the mordant-containing layer.

25. The silver halide photographic material according to claim 15, wherein the dye and the mordant are present in the same hydrophilic colloid layer.

26. The silver halide photographic material according to claim 16, wherein the dye and the mordant are present in the same hydrophilic colloid layer.

* * * * *